US008561720B2

(12) United States Patent
Edbury et al.

(10) Patent No.: US 8,561,720 B2
(45) Date of Patent: Oct. 22, 2013

(54) METHODS AND SYSTEMS FOR DRILLING

(71) Applicant: Shell Oil Company, Houston, TX (US)

(72) Inventors: David Alston Edbury, Reading (GB); Jose Victor Guerrero, Spring, TX (US); Duncan Charles MacDonald, Houston, TX (US); James Bryon Rogers, Katy, TX (US); Donald Ray Sitton, Humble, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/649,482

(22) Filed: Oct. 11, 2012

(65) Prior Publication Data

US 2013/0032401 A1 Feb. 7, 2013

Related U.S. Application Data

(63) Continuation of application No. PCT/US2011/031920, filed on Apr. 11, 2011.

(60) Provisional application No. 61/323,251, filed on Apr. 12, 2010.

(51) Int. Cl.
*E21B 7/06* (2006.01)

(52) U.S. Cl.
USPC ..... 175/26; 175/62

(58) Field of Classification Search
USPC ..... 175/26, 62, 73
See application file for complete search history.

(56) References Cited

U.S. PATENT DOCUMENTS

| | | | | |
|---|---|---|---|---|
| 5,148,875 | A * | 9/1992 | Karlsson et al. | 175/62 |
| 5,713,422 | A | 2/1998 | Dhindsa | 175/27 |
| 7,195,083 | B2 * | 3/2007 | Eppink et al. | 175/61 |
| 2003/0079912 | A1 | 5/2003 | Leuchtenberg | 175/38 |
| 2004/0222023 | A1 | 11/2004 | Haci et al. | 175/61 |
| 2008/0066958 | A1 | 3/2008 | Haci et al. | 175/27 |
| 2008/0164025 | A1 | 7/2008 | Peter | 166/255.2 |
| 2009/0188720 | A1 * | 7/2009 | Johnson et al. | 175/61 |
| 2010/0191471 | A1 | 7/2010 | deReynal | 702/9 |

* cited by examiner

*Primary Examiner* — William P Neuder

(57) ABSTRACT

A method of steering a drill bit to form an opening in a subsurface formation, comprises a) determining a distance from design of a well, and b) determining an angle offset from design of the well wherein angle offset from design is the difference between the inclination and azimuth of the hole and the inclination and azimuth of plan, c) wherein at least one distance from design and at least one angle offset from design are determined in real time based, at least in part, on a position of the hole at the last survey, a position at a projected current location of the bit, and a projected position of the bit.

13 Claims, 23 Drawing Sheets

| MD (m) | CL (m) | Inc (°) | Azi (°) | TVD (m) | N/S (m) | E/W (m) |
|---|---|---|---|---|---|---|
| 1842.47 | 18.92 | 90.38 | 267.7 | 617.43 | -149.9 | -1246.08 |
| 1861.29 | 18.82 | 90.44 | 268.45 | 617.3 | -150.53 | -1264.88 |
| 1880.17 | 18.88 | 90.81 | 267.82 | 617.09 | -151.15 | -1283.75 |
| 1899.02 | 18.85 | 90.94 | 268.45 | 616.81 | -151.76 | -1302.59 |
| 1917.93 | 18.91 | 90.06 | 271.07 | 616.64 | -151.84 | -1321.5 |
| 1936.79 | 18.86 | 90.19 | 270.45 | 616.6 | -151.59 | -1340.36 |
| 1955.67 | 18.88 | 89.38 | 270.95 | 616.67 | -151.36 | -1359.23 |
| 1974.5 | 18.83 | 89.44 | 271.7 | 616.88 | -150.92 | -1378.05 |
| 1993.38 | 18.88 | 89.56 | 271.32 | 617.03 | -150.43 | -1396.93 |
| 2012.26 | 18.88 | 89.63 | 270.57 | 617.16 | -150.12 | -1415.81 |
| 2031.07 | 18.81 | 90.06 | 270.45 | 617.21 | -149.95 | -1434.62 |

FIG. 18B

462

| B | C | D | E | F | I | J |
|---|---|---|---|---|---|---|
| MD (m) | CL (m) | Inc (°) | Azi (°) | TVD (m) | N/S (m) | E/W (m) |
| 1823.55 | 18.92 | 90 | 268.32 | 617.5 | -149.24 | -1227.17 |
| 1842.47 | 18.92 | 90.38 | 267.7 | 617.43 | -149.9 | -1246.08 |
| 1861.29 | 18.82 | 90.44 | 268.45 | 617.3 | -150.53 | -1264.88 |
| 1880.17 | 18.88 | 90.81 | 267.82 | 617.09 | -151.15 | -1283.75 |
| 1899.02 | 18.85 | 90.94 | 268.45 | 616.81 | -151.76 | -1302.59 |
| 1917.93 | 18.91 | 90.06 | 271.07 | 616.64 | -151.84 | -1321.5 |
| 1936.79 | 18.86 | 90.19 | 270.45 | 616.6 | -151.59 | -1340.36 |
| 1955.67 | 18.88 | 89.38 | 270.95 | 616.67 | -151.36 | -1359.23 |
| 1955.79 | 0.12 | 89.38 | 270.95 | 616.67 | -151.36 | -1359.35 |
| 1959.79 | 4 | 89.28 | 271.98 | 616.72 | -151.26 | -1363.35 |
| 1974.5 | 14.71 | 89.44 | 271.7 | 616.88 | -150.78 | -1378.05 |
| 1993.38 | 18.88 | 89.56 | 271.32 | 617.05 | -150.29 | -1396.93 |
| 2012.26 | 18.88 | 89.63 | 270.57 | 617.18 | -149.97 | -1415.8 |
| 2031.07 | 18.81 | 90.06 | 270.45 | 617.23 | -149.81 | -1434.61 |

460

FIG. 18C

464

METHODS AND SYSTEMS FOR DRILLING

PRIORITY CLAIM

This application is a continuation of International Application PCT/US2011/031920, filed Apr. 11, 2011, which claims the benefit of U.S. Provisional Application No. 61/323,251, filed Apr. 12, 2010, the entire disclosures of which are hereby incorporated by reference.

BACKGROUND

1. Field of the Invention

The present invention relates generally to methods and systems for drilling in various subsurface formations such as hydrocarbon containing formations.

2. Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources.

In drilling operations, drilling personnel are commonly assigned various monitoring and control functions. For example, drilling personnel may control or monitor positions of drilling apparatus (such as a rotary drive or carriage drive), collect samples of drilling fluid, and monitor shakers. As another example, drilling personnel adjust the drilling system ("wiggle" a drill string) on a case-by-case basis to adjust or correct drilling rate, trajectory, or stability. A driller may control drilling parameters using joysticks, manual switches, or other manually operated devices, and monitor drilling conditions using gauges, meters, dials, fluid samples, or audible alarms. The need for manual control and monitoring may increase costs of drilling of a formation. In addition, some of the operations performed by the driller may be based on subtle cues from drilling apparatus (such as unexpected vibration of a drilling string). Because different drilling personnel have different experience, knowledge, skills, and instincts, drilling performance that relies on such manual procedures may not be repeatable from formation to formation or from rig to rig. In addition, some drilling operations (whether manual or automatic) may require that a drill bit be stopped or pulled off the bottom of the well, for example, when changing from a rotary drilling mode to a slide drilling mode. Suspension of drilling during such operations may reduce the overall rate of progress and efficiency of drilling.

Bottom hole assemblies in drilling systems often include instrumentation, such as Measurement While Drilling (MWD) tools. Data from the downhole instrumentation may be used to monitor and control drilling operations. Providing, operating, and maintaining such downhole measuring tools may substantially increase the cost of a drilling system. In addition, since data from downhole instrumentation must be transmitted to the surface (such as by mud pulsing or periodic electromagnetic transmissions), the downhole instrumentation may provide only limited "snapshots" at periodic intervals during the drilling process. For example, a driller may have to wait 20 or more seconds between updates from a MWD tool. During the gaps between updates, the information from the downhole instrumentation may become stale and lose its value for controlling drilling.

SUMMARY

Embodiments described herein generally relate to systems and methods for automatically drilling in subsurface formations.

A method of assessing, for a particular mud motor, a relationship between motor output torque and differential pressure across the mud motor includes applying torque to a drill string at the surface of the formation to rotate the drill string in the formation at a specified drill string rpm; pumping drilling fluid at a specified flow rate to the mud motor; operating the mud motor at a specified differential pressure to turn the drill bit to drill in the formation; reducing the applied torque on the drill string to reduce the drill string rotational speed to a target drill string speed while continuing to operate the mud motor at the specified differential pressure; measuring the torque on the drill string at the surface of the formation that is needed to hold the drill string at the target drill string speed while the mud motor is at the specified differential pressure (and the drill bit thus continues to drill); and modeling a relationship between torque on the drill bit and differential pressure across the mud motor based on the measured holding torque and the specified differential pressure.

A method of assessing weight on a drill bit used to form an opening in a subsurface formation includes assessing a relationship between a weight on a drill bit and a differential pressure across the mud motor based on at least one analytical model; measuring a differential pressure across a mud motor; assessing a relationship between torque on a drill bit used to form the opening and differential pressure across a motor used to operate the drill bit using at least one measurement of torque on a drill string at the surface of the formation; assessing weight on the drill bit using the analytical model, the assessed relationship between torque on the drill bit and differential pressure across the motor, and the assessed relationship between weight on the drill bit and torque on the drill bit.

A method of assessing weight on a drill bit used to form an opening in a subsurface formation, includes measuring at least one pressure to determine a differential pressure across a mud motor; determining a motor output torque based on the measured differential pressure; measuring torque on a drill string; measuring an off-bottom rotating torque; and determining a weight on bit required to induce weight on bit-induced sideload torque based on at least one of the measurements.

A method of assessing a pressure in a system used to form an opening in a subsurface formation, comprising: assessing a baseline pressure when a drill bit is freely rotating in the opening in the formation; assessing a baseline viscosity of fluid flowing through the drill bit based on the assessed baseline pressure; assessing flowrate, density, and viscosity of fluid flowing through the drill bit as the drill bit is used to drill the opening further into the formation; and reassessing the baseline pressure based on the assessed flowrate, density, and viscosity of the fluid flowing through the drill bit.

A method of automatically placing a drill bit used to form an opening in a subsurface formation on a bottom of the opening being formed includes increasing a flow rate in a drill string to a target flow; controlling a flow rate of fluid into the drill string to be substantially the same as a flowrate of fluid out of the opening; allowing a fluid pressure to reach a relatively steady state; automatically moving the drill bit towards the bottom of the opening at a selected rate of advance until a consistent increase in measured differential pressure indicates that the drill bit is at the bottom of the opening.

A method of automatically picking up a drill bit off the bottom of an opening in a subsurface formation includes setting a predetermined level of differential pressure across the motor at which pickup of the drill bit is initiated; monitoring the differential pressure across the motor; allowing differential pressure across a mud motor to decrease to the predetermined level; and when the predetermined level is reached, automatically picking up the drill bit.

A method of automatically detecting a stall in a mud motor providing rotation to a drill bit used to forming an opening in a subsurface formation and responding to the stall includes assigning a maximum differential pressure allowed on a mud motor used to operate the drill bit; assessing a stall condition in the mud motor when the assessed differential pressure is at or above the assigned maximum differential pressure; and automatically shutting off flow to a mud motor when the stall condition is assessed.

A method of assessing hole cleaning effectiveness of drilling includes determining a mass of cuttings removed from a well, wherein determining the mass of cuttings removed from a well includes measuring a total mass of fluid entering a well; measuring a total mass of fluid exiting the well; determining a difference between the total mass of fluid exiting the well and total mass of fluid entering the well; determining a mass of rock excavated in the well; determining a mass of cuttings remaining in the well, wherein determining the mass of cuttings remaining in the well includes determining a difference between the determined mass of rock excavated in the well and the determined mass of cuttings removed from the well.

A method of monitoring performance of a solids handling system includes monitoring density and mass flow rate of fluid exiting a well; monitoring density and mass flow rate of fluid returning to the well; and comparing the density of the fluid exiting the well to the density of the fluid returning to the well.

A method of controlling a direction of a toolface of a bottom hole assembly for slide drilling includes synchronizing the toolface, wherein synchronizing the toolface includes determining a relationship between the rotational position of the down hole toolface with a rotational position at the surface of the formation for at least one point in time; stopping rotation of the drill string coupled to the bottom hole assembly; controlling torque at the surface of the drill string to control a rotational position of the toolface; and commencing slide drilling.

A method of controlling a direction of drilling of a drill bit used to form an opening in a subsurface formation includes varying a speed of the drill bit during rotational drilling such that the drill bit is at a first speed during a first portion of the rotational cycle and at a second speed during a second portion of the rotational cycle, wherein the first speed is higher than the second speed, and wherein operating at the second speed in the second portion of the rotational cycle causes the drill bit to change the direction of drilling.

A method of predicting a direction of drilling of a drill bit used to form an opening in a subsurface formation includes assessing depth of the drill bit at one or more selected points along the opening; estimating the attitudes at the start and end point of at least one slide drilled section; and assessing a virtual measured depths by projecting back to one or more previous measured depths.

A method of assessing a vertical depth of a well bore, drilling tool operating within a well bore or a drill bit used to form an opening in a subsurface formation includes assessing a static downhole pressure at a fixed and known location relative to the wellbore, drilling tool or drill bit; assessing density of fluid flowing into the wellbore; and assessing a vertical depth of the drill bit based on the assessed downhole pressure and the assessed density.

A method of steering a drill bit to form an opening in a subsurface formation includes taking at least one survey is taken with a MWD tool; establishing a definitive path of the MWD sensor with the survey data from the MWD tool; and projecting the attitude and position of the drill bit using real-time data in combination with the path from of the MWD tool.

A method of steering a drill bit to form an opening in a subsurface formation includes determining a distance from design of a well; determining an angle offset from design of the well, wherein angle offset from design is the difference between what the inclination and azimuth of the hole and the plan, wherein at least one distance from design and at least one angle offset from design are determined in real time based on a position of the hole at the last survey, a position at a projected current location of the bit, and a projected position of the bit.

A method of estimating toolface of a bottom hole assembly between downhole updates during drilling in a subsurface formation includes encoding a drill string; running the drill string in the formation in a calibration mode to model drill string windup in the formation; during drilling operations, measuring a rotational position of the drill string at the surface of the formation; and estimating the toolface of the bottom hole assembly based on the rotational position of the drill string at the surface and the drill string windup model.

In various embodiments, a system includes a processor and a memory coupled to the processor and configured to store program instructions executable by the processor to implement automatic drilling, such as using the methods described above.

In various embodiments, a computer readable memory medium includes program instructions that are computer-executable to implement automatic drilling, such as using the methods described above.

BRIEF DESCRIPTION OF THE DRAWINGS

Advantages of the present invention may become apparent to those skilled in the art with the benefit of the following detailed description and upon reference to the accompanying drawings in which:

FIG. 18B is tabulation of the original survey points for one example of drilling in rotary drilling and slide drilling modes;

FIG. 18C is tabulation of the survey points including added virtual survey points.

DETAILED DESCRIPTION

Figures 1, 1A, 1B:
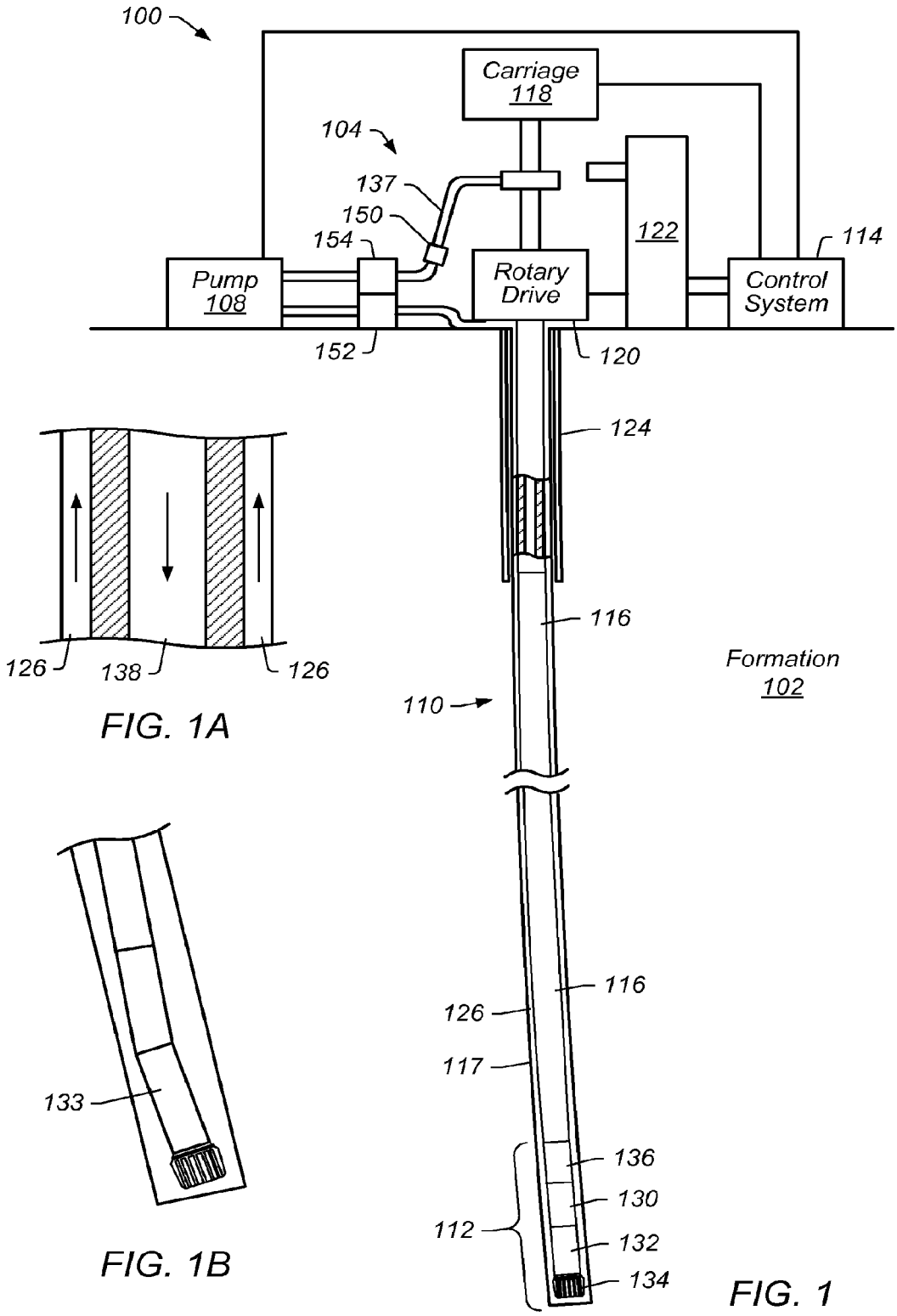
FIGS. 1 and 1A illustrate a schematic diagram of a drilling system with a control system for performing drilling operations automatically according to one embodiment.
FIG. 1B illustrates one embodiment of bottom hole assembly including a bent sub.

The following description generally relates to systems and methods for drilling in the formations. Such formations may be treated to yield hydrocarbon products, hydrogen, and other products.

"Continuous" or "continuously" in the context of signals (such as magnetic, electromagnetic, voltage, or other electrical or magnetic signals) includes continuous signals and signals that are pulsed repeatedly over a selected period of time. Continuous signals may be sent or received at regular intervals or irregular intervals.

A "fluid" may be, but is not limited to, a gas, a liquid, an emulsion, a slurry, and/or a stream of solid particles that has flow characteristics similar to liquid flow.

"Fluid pressure" is a pressure generated by a fluid in a formation. "Lithostatic pressure" (sometimes referred to as "lithostatic stress") is a pressure in a formation equal to a weight per unit area of an overlying rock mass. "Hydrostatic pressure" is a pressure in a formation exerted by a column of fluid.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

"Thickness" of a layer refers to the thickness of a cross section of the layer, wherein the cross section is normal to a face of the layer.

"Viscosity" refers to kinematic viscosity at 40° C. unless otherwise specified. Viscosity is as determined by ASTM Method D445.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

In some embodiments, some or all of the drilling operations at a formation are performed automatically. A control system may, in certain embodiments, perform the monitoring functions usually assigned to a driller via direct measurement and model matching. In certain embodiments, a control system may be programmed to include control signals that emulate control signals from a driller (for example, control inputs from joysticks and manual switches). In some embodiments, trajectory control is provided by unmanned survey systems and integrated steering logic.

FIG. 1 illustrates a drilling system with a control system for performing drilling operations automatically according to one embodiment. Drilling system 100 is provided at formation 102. Drilling system 100 includes drilling platform 104, pump 108, drill string 110, bottom hole assembly 112, and control system 114. Drill string 110 is made of a series of drill pipes 116 that are sequentially added to drill string 110 as well 117 is drilled in formation 102.

Drilling platform 104 includes carriage 118, rotary drive system 120, and pipe handling system 122. Drilling platform 104 may be operated to drill well 117 and to advance drill string 110 and bottom hole assembly 112 into formation 104. Annular opening 126 may be formed between the exterior of drill string 110 and the sides of well 117. Casing 124 may be provided in well 117. Casing 124 may be provided over the entire length of well 117 or over a portion of well 117, as depicted in FIG. 1.

Bottom hole assembly 112 includes drill collar 130, mud motor 132, drill bit 134, and measurement while drilling (MWD) tool 136. Drill bit 134 may be driven by mud motor 132. Mud motor 132 may be driven by a drilling fluid passed through the mud motor. The speed of drill bit 134 may be approximately proportional to the differential pressure across mud motor 132. As used herein, "differential pressure across a mud motor" may refer to the difference in pressure between fluid flowing into the mud motor and fluid flowing out of the mud motor. Drilling fluid may be referred to herein as "mud".

In some embodiments, drill bit 134 and/or mud motor 132 are mounted on a bent sub of bottom hole assembly 112. The bent sub may orient the drill bit at angle (off-axis) relative to the attitude of bottom hole assembly 112 and/or the end of drill string 110. A bent sub may be used, for example, for directional drilling of a well. FIG. 1B illustrates one embodiment of bottom hole assembly including a bent sub. Bent sub 133 may be establish a drilling direction that is at angle relative to the axial direction of a bottom hole assembly and/or wellbore.

MWD tool 136 may include various sensors for measuring characteristics in drilling system 100, well 117, and/or formation 102. Examples of characteristics that may be measured by the MWD tool include natural gamma, attitude (inclination & azimuth), toolface, borehole pressure, and temperature. The MWD tool may transmit data to the surface by way of mud pulsing, electromagnetic telemetry, or any other form of data transmission (such as acoustic or wired drillpipe). In some embodiments, an MWD tool may be spaced away from the bottom hole assembly and/or mud motor.

In some embodiments, pump 108 circulates drilling fluid through mud delivery line 137, core passage 138 of drill string 110, through mud motor 132, and back up to the surface of the formation through annular opening 126 between the exterior of drill string 110 and the side walls of well 117, as illustrated in FIG. 1A. Pump 108 includes pressure sensors 150, suction flow meter 152, and return flow meter 154. Pressure sensors 150 may be used to measure the pressure of fluid in drilling system 100. In one embodiment, one of pressure sensors 150 measures standpipe pressure. Flow meters 152 and 154 may measure the mass of fluid flowing into and out of drill string 110.

A control system for a drilling system may include a computer system. In general, the term "computer system" may refer to any device having a processor that executes instructions from a memory medium. As used herein, a computer system may include processor, a server, a microcontroller, a microcomputer, a programmable logic controller (PLC), an application specific integrated circuit, and other programmable circuits, and these terms are used interchangeably herein.

A computer system typically includes components such as CPU with an associated memory medium. The memory medium may store program instructions for computer programs. The program instructions may be executable by the CPU. A computer system may further include a display device such as monitor, an alphanumeric input device such as keyboard, and a directional input device such as mouse or joystick.

A computer system may include a memory medium on which computer programs according to various embodiments may be stored. The term "memory medium" is intended to include an installation medium, CD-ROM, a computer system memory such as DRAM, SRAM, EDO RAM, Rambus RAM, etc., or a non-volatile memory such as a magnetic media, e.g., a hard drive or optical storage. The memory medium may also include other types of memory or combinations thereof. In addition, the memory medium may be located in a first computer, which executes the programs or may be located in a second different computer, which connects to the first computer over a network. In the latter instance, the second computer may provide the program instructions to the first computer for execution. A computer system may take various forms such as a personal computer system, mainframe computer system, workstation, network appliance, Internet appliance, personal digital assistant ("PDA"), television system or other device.

The memory medium may store a software program or programs operable to implement a method for processing insurance claims. The software program(s) may be implemented in various ways, including, but not limited to, procedure-based techniques, component-based techniques, and/or object-oriented techniques, among others. For example, the software programs may be implemented using Java, ActiveX controls, C++ objects, JavaBeans, Microsoft Foundation Classes ("MFC"), browser-based applications (e.g., Java applets), traditional programs, or other technologies or methodologies, as desired. A CPU such as host CPU executing code and data from the memory medium may include a means for creating and executing the software program or programs according to the embodiments described herein.

Figure 2:
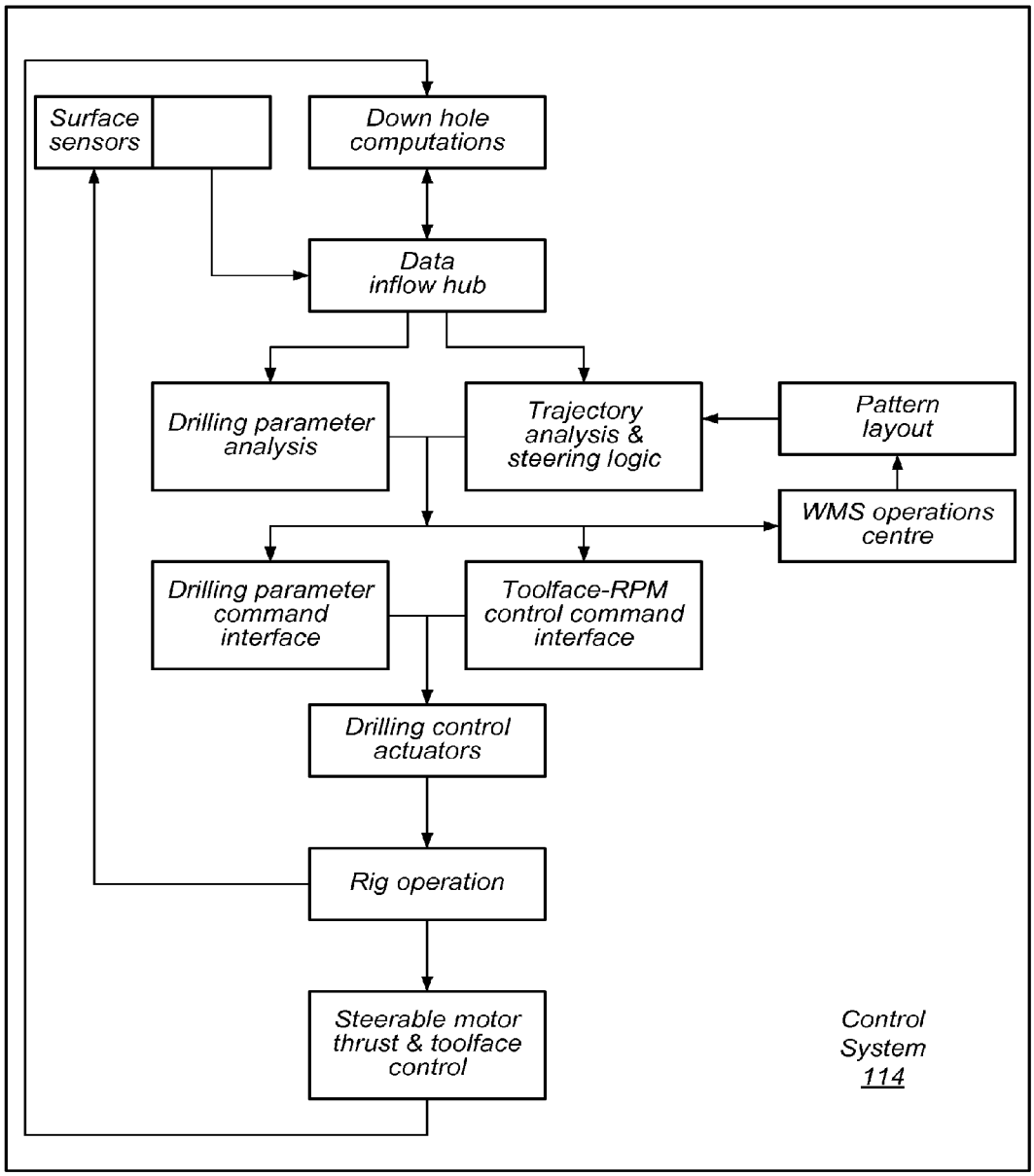
FIG. 2 is a schematic illustrating one embodiment of a control system.

FIG. 2 is a schematic illustrating one embodiment of a control system. Control system 114 may implement control of various devices, receive sensor data, and perform computations. In one embodiment, a programmable logic controller ("PLC") of a control system implements the following subroutines: Startup; Lower bit to bottom; Start drilling; Monitor drilling; Start slide from rotary drilling; Maintain tool face & slide drill; Start rotary drilling from slide; Stop drilling; Raise string to end position.

Each subroutine may be controlled based on user-defined setpoints and the output of various software routines. Once each joint of drill pipe is made up, control may be handed over to a PLC of the control system.

Drilling operations may include rotary drilling, slide drilling, and combinations thereof. As a general matter, rotary drilling may follow a relatively straight path and slide drilling may follow a relatively curved path. In some embodiments, rotary drilling and slide drilling modes are used in combination to achieve a specified trajectory.

Various parameters that may be monitored include mud motor stall detection & recovery, surface thrust limits, mud inflow/outflow balance, torque, weight on bit, standpipe pressure stability, top drive position, rate of penetration, and torque stability. A PLC may automatically implement out of range condition responses for any or all of these parameters.

In certain embodiments, an opening in a formation is made using rotary drilling only (without slide drilling). Drilling parameters are controlled to adjust inclination. In certain embodiments, dropping is accomplished by increasing the mud flow rate whilst decreasing rate of penetration and build is accomplished by a combination of decreased RPM and decreased flow with increased Rate of penetration.

In certain embodiments, a drilling system includes an integrated automated pipe handler. The integrated automated pipe handler may allow the drilling system to drill entire sections automatically. Services such as drilling fluid, fuel, and waste removal may be maintained.

A PLC may automatically control one or more of the parameters.

In some embodiments, a control system provides a suite of engineering calculations needed for drilling a well. Engineering modules may be provided, for example, for survey, wellplan, directional drilling, torque and drag, and hydraulics. In one embodiment, calculations are performed against real-time data received from the drilling rig equipment sensors, mud equipment sensors and MWD and report to the control system via a Database (such as a SQL Server Database). The calculation results may be used to monitor and control the drilling rig equipment as drilling is executed.

In some embodiment, a control system includes a graphical user interface. The graphical user interface may display, and allow input for various drilling parameters. The graphical user interface screen may update constantly while the program is running and receiving data. The display may include such information as:

the current depth, pressures and torque of the wellbore and drill string, and a BHA performance analysis which provides the directional performance summary of the drilling slide and rotate intervals.

a summary of the position of the last survey position, current end of hole, the point on the wellplan that represent the closest point from the end of hole and finally the position of a projected distance from the wellplan. These may all be represented as a survey position illustrating depth, inclination, azimuth and true vertical depth at each position.

the distance and direction between the end of hole and the wellplan, and the current drilling status and the directional tuning results.

In some drilling operations, tests are performed to calibrate instruments and to determine relationships among various parameters and characteristics. For example, at the commencement of a drilling operation, a drill-on test may be run to determine flow rate against pressure, etc. The conditions during the calibration tests may not, however, accurately reflect the conditions actually encountered during drilling. As a result, the data from some commonly used calibration tests may be inadequate to effectively control drilling. Moreover, some existing calibration tests do not provide accurate enough information to optimize performance (such as an optimal rate of penetration or directional control), or to deal with adverse conditions that may arise during drilling, such as stalling of the mud motor.

Figure 3:
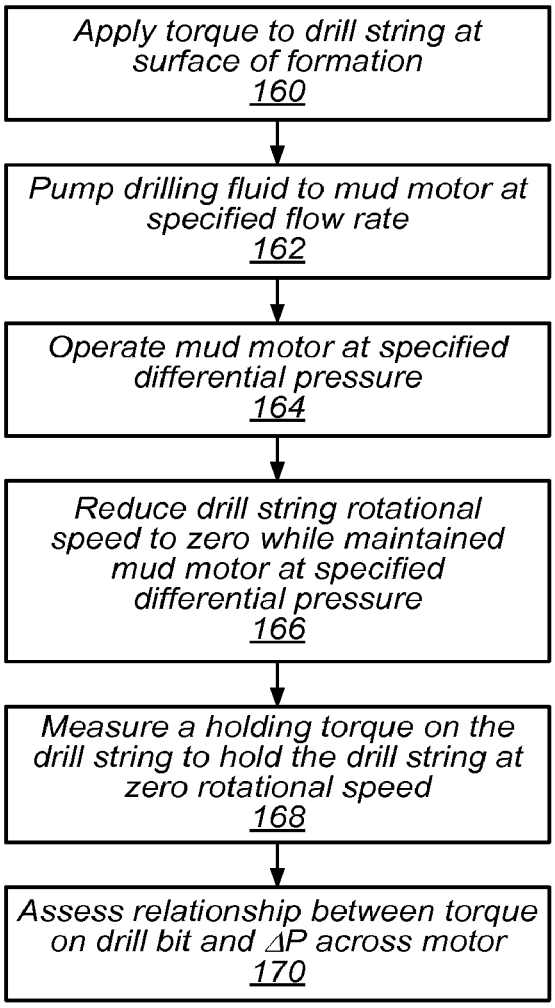
FIG. 3 illustrates a flow chart for a method of assessing a relationship between motor output torque and differential pressure across the mud motor according to one embodiment.

In some embodiments, a relationship is assessed, for a particular mud motor, between motor output torque and differential pressure across the mud motor. The assessed relationship may be used to control drilling operations using the mud motor. FIG. 3 illustrates assessing a relationship between motor output torque and differential pressure across the mud motor according to one embodiment. At 160, torque is applied to a drill string at the surface of the formation to rotate the drill string in the formation at a specified drill string rpm. In some embodiments, the drill string may be rotated specifically for performing a calibration test to assess a relationship between motor output torque and differential pressure as described in this FIG. 3. In other embodiments, the drill string may already be rotating as part of rotary drilling of a portion of the formation at the time the calibration is started.

At 162, drilling fluid is pumped to the mud motor at a specified flow rate to turn the drill bit to drill in the formation. At 164, the mud motor is operated at a specified differential pressure (which may be proportional to the flow rate of the drilling fluid) to turn the drill bit to drill in the formation.

At 166, the applied torque on the drill string is reduced to reduce the drill string rotational speed to zero while continuing to operate the mud motor at the specified differential pressure. The reduction in torque may be accomplished by reducing the speed of a rotary drive of the drilling system.

At 168, a holding torque on the drill string at the surface of the formation is measured. The holding torque may be the torque required to hold the drill string at the zero drill string speed while the mud motor is at the specified differential pressure (and the drill bit thus continues to drill).

At 170, a relationship is modeled between torque on the drill bit and differential pressure across the mud motor based on the measured holding torque and the specified differential pressure. In certain embodiments, the torque on the drill bit is assumed to be the value indicated by the mud motor pressure differential.

Figure 4:
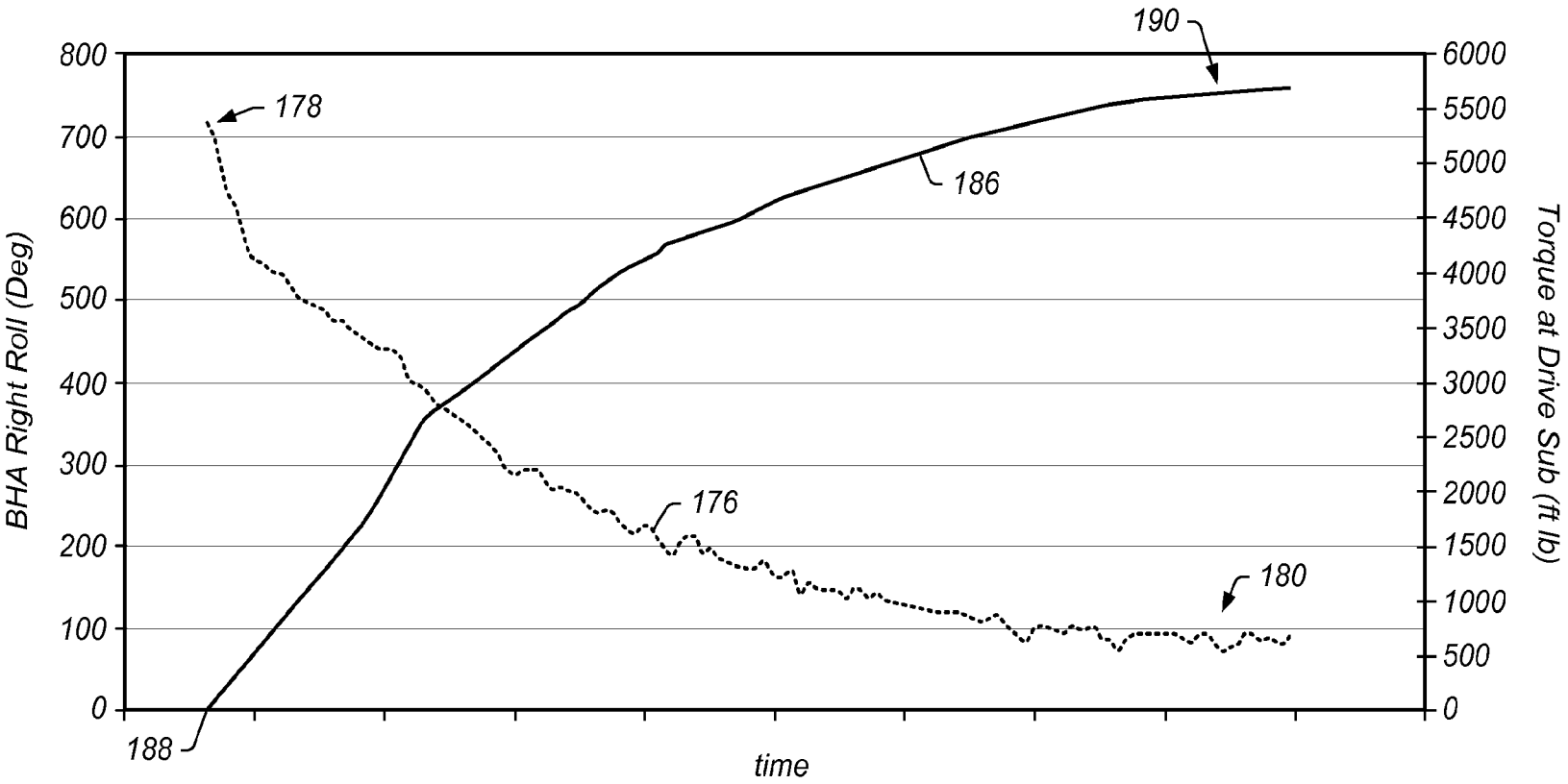
FIG. 4 illustrates one embodiment of torque measured on a drill string at the surface of a formation against time during a test to determine a torque/differential pressure relationship at a transition from rotary drilling to slide drilling.

FIG. 4 illustrates one embodiment of torque measured on a drill string at the surface of a formation against time during a test to determine a torque/differential pressure relationship at a transition from rotary drilling to slide drilling. Curve 176 plots torque in the drill string against time. Initially, a rotary drive may be turning a drill string such that the torque measured at the surface of the formation is at relatively stable level (about 5,500 ft-lbs in this example). At time 178, the rotary is slowed down. As the drill string is slowed down, torque on the drill string declines. At 180, torque may reach a relatively stable value (about 650 ft-lbs in this example). The torque at the surface will reduce to a torque equal to the torque output of the mud motor. Thus, the stable torque reading of torque at the surface at 180 may approximate the torque at the mud motor.

Figure 5:
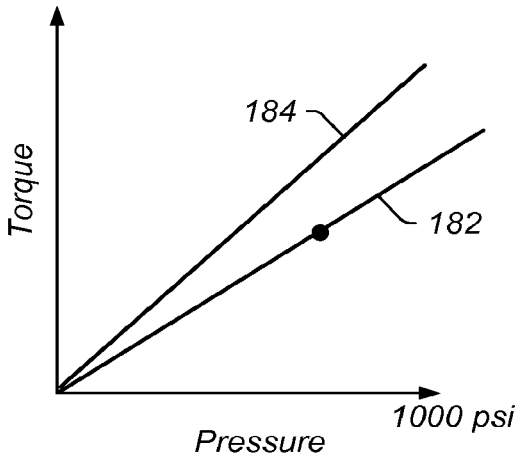
FIG. 5 is a plot of mud motor output torque against differential pressure across the motor according to one embodiment.

The relationship between torque on the drill bit and differential pressure across the mud motor may be a linear relationship. FIG. 5 is a plot of mud motor output torque against differential pressure across the motor according to one embodiment. Curve 182 illustrates the relationship between torque on the drill bit and differential pressure in this example. In some embodiments, a linear relationship is established using two points: the first point being [Torque=holding torque at specified differential pressure, Differential pressure=specified differential pressure] and second point being at [Torque=0; Differential pressure=0]. Since the [Torque=0; Differential pressure=0] may be assumed without running a test, the linear relationship may thus be determined with only one test point, namely, [Torque=holding torque at specified differential pressure, Differential pressure=specified differential pressure].

For comparison, FIG. 5 includes motor specification curve 184. Motor specification curve 184 represents what a manufacturer's motor specification curve might typically look like for a mud motor tested to produce curve 182.

In some embodiments, a drill string is allowed to unwind before measuring holding torque. Referring again to FIG. 4, curve 186 illustrates orientation of a bottom hole assembly as the drill string unwinds. The plot shows the relationship between torque and BHA toolface roll when string RPM at surface is zero. With the bit on bottom drilling, as the drill pipe RPM is set to zero, the torque trapped in the string rotates the BHA to the right until the torque in the string at the surface is balanced with the reactive torque from the motor trying to rotate the BHA the opposite direction. Thus, at 188, as rotation of the rotary is stopped, the drill string is at a right roll of 0 degrees. As time elapses, the drill string unwinds until the drill string reaches a stable level at 190 (about 750 degrees, 2.1 turns, in this example). The surface torque measurement when BHA roll stabilizes may be a direct measure of motor torque output. Unwinding may take, in one example, about 2.5 minutes.

In some embodiments, a test to assess a relationship between torque on the drill bit and differential pressure across a mud motor is repeated periodically. The test may be used, for example, to check motor performance as drilling progresses in a formation. In addition, the test can be performed any time slide drilling occurs and the surface torque has stabilized.

Differential pressure across the mud motor may be measured directly, or estimated from other measured characteristics. In some embodiments, differential pressure across the mud motor is estimated from standpipe pressure readings. Periodically "zeroing" may be performed to minimize the error on the captured "off bottom" standpipe pressure measurement. In other embodiments, the differential pressure across the mud motor may be established by calculating the off bottom circulating pressure and comparing it to actual standpipe pressure.

In some embodiments, multiple weight on bit calculations are monitored as a diagnostic tool. In one embodiment, the values are monitored automatically. For example, a control system may monitor conditions and assess: (1) current surface tension—off bottom surface tension; (2) torque and drag model weight on bit ("WOB") using surface tension and off bottom friction factor; (3) torque and drag model WOB using torque and off bottom friction factor; and (4) drill-on test WOB against motor differential pressure.

In some embodiments, control system may include logic to control drilling based on different sub-sets of the assessments described above. For example, if slide drilling, methods 1 and 3 above may not be valid. If, during slide drilling the BHA hangs up, method 2 may also become invalid (method 2 may, for example, read too high as not all of the weight is transferring to the bit. In some embodiments, monitoring logic may be based on one or more comparisons between two or more of the assessment methods given above. One example of monitoring logic is "If during slide drilling, method 4 differs from method 2 by more than (user setpoint %), 'hang-up' detected." As another example, if, during rotary drilling, WOB from assessment method 3 is greater than assessment method 2 by more than (user setpoint %), then the automated system may report detection of an "excess torque to rotate string" condition. In some embodiments, ROP or string RPM may be reduced until the weight on bit assessment(s) come back into tolerance.

In certain embodiments, mechanical specific energy ("MSE") calculations are used in an automatic drilling process. In the case described above, for example, "excess torque to rotate string" may register as high MSE.

In an embodiment, weight on a drill bit used to form an opening in a subsurface formation is assessed using measurement of differential pressures across a mud motor.

Figure 6:
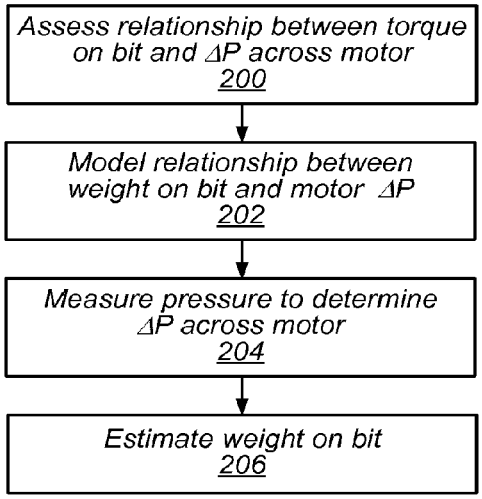
FIG. 6 illustrates a flow chart for a method of assessing weight on a drill bit using differential pressure according to one embodiment.

FIG. 6 illustrates assessing weight on a drill bit using differential pressure according to one embodiment. At 200, a relationship between torque on a drill bit used to form an opening and differential pressure across a motor used to operate the drill bit is established. In some embodiments, the relationship is established using measurement of torque on a drill string at the surface of the formation, as described above with relative to FIG. 4.

At 202, a relationship of weight on drill bit to motor differential pressure is modeled. In one embodiment, the weight on bit is modeled based on a difference in hook load method. In another embodiment, the weight on bit is based on a dynamic torque and drag model for example the bit induced sideload torque estimate for weight on bit may be used.

At 204, during drilling operations, differential pressure across the motor is measured. At 206, the weight on the drill bit is estimated using the model established at 202. A relationship between weight on the drill bit and motor differential pressure (torque on the drill bit) assessed as described above may remain valid while drilling in a given lithology.

Figure 7:
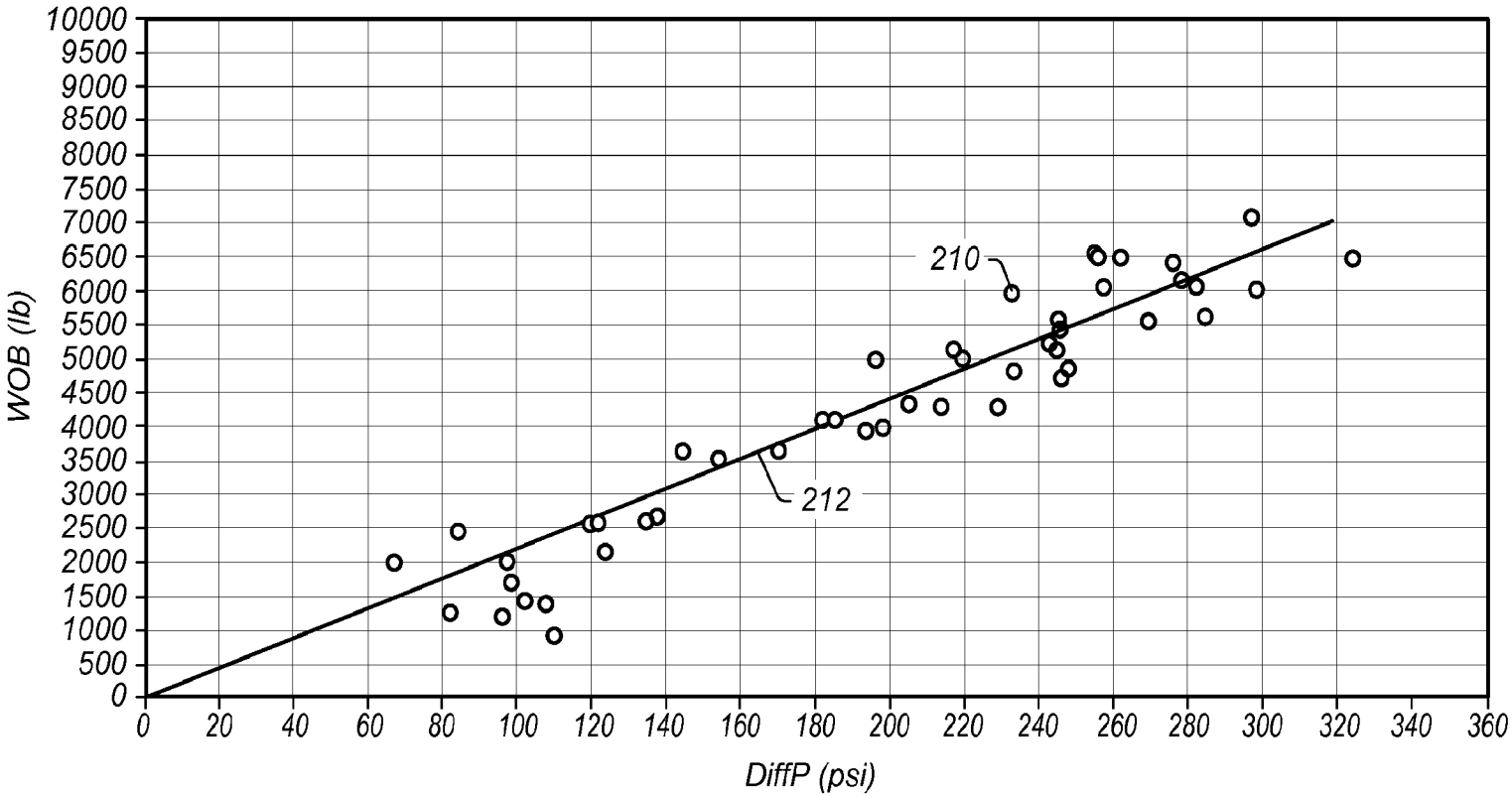
FIG. 7 illustrates an example of relationship established using multiple test points.

In some embodiments, WOB is assessed for multiple differential pressure readings made the course of a drilling operation. The data points may be curve fitted to continuously estimate WOB based on measured differential pressure. The curve fit may define a linear relationship between WOB and differential pressure. In one embodiment, the differential pressures are read during one or more drill-on tests. FIG. 7 illustrates an example of relationship established using multiple test points. Points 210 may be curve fitted to produce linear relationship 212.

In some embodiments, a test to relate WOB to differential pressure is performed while the bulk of the drill string is within a drill casing. When the bulk of the drill string is within the drill casing, the measured weight on bit using either the "difference in hook load" method or a dynamic torque and drag model may be relatively accurate, as the uncertainty of open hole friction factor may be minimized. In one embodiment, a test is run when first drilling out of a casing string into a new formation. In some embodiments, a WOB/differential pressure relationship is determined in a horizontal section of a well.

In some embodiments of a weight on bit assessment for a formation, an increase in sideload associated with increasing weight on bit is accounted for using torque measurements taken when the drill string is in the formation. For example, torque measurement may be used to solve for unknown weight on bit using a torque and drag model. In one embodiment, measurements are taken, and weight on bit assessed, at each joint, for example, each time drilling is started as part of a drill-on test. In certain embodiments, a constant friction factor is assumed.

Figure 8:
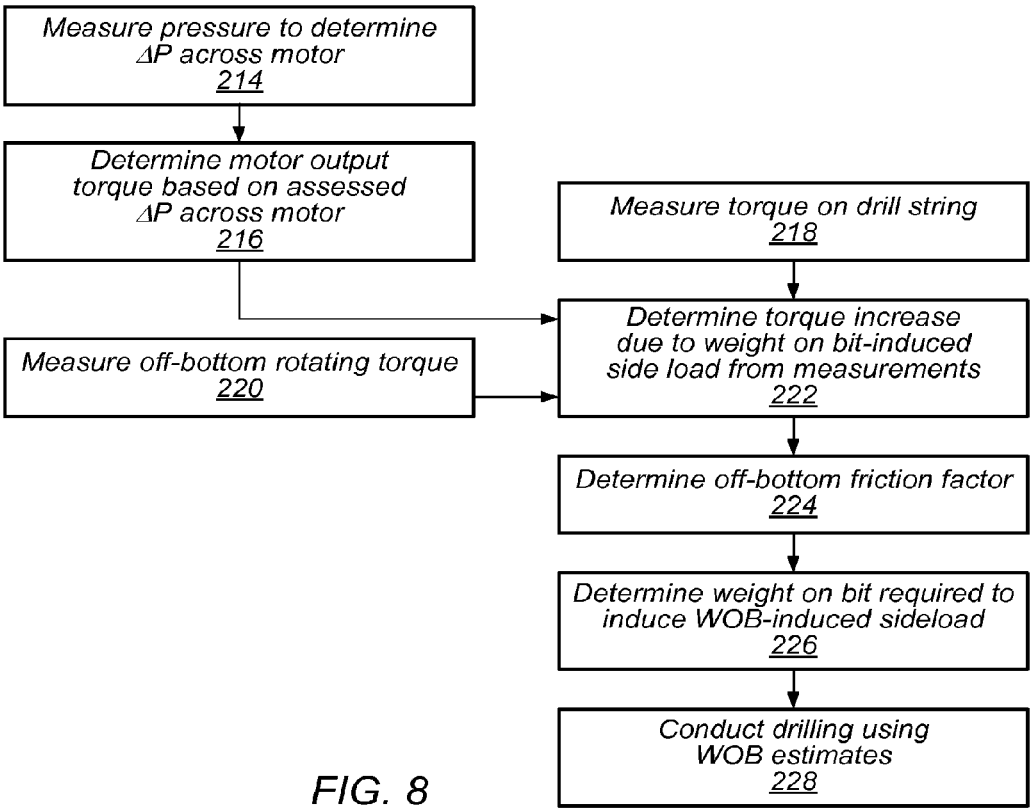
FIG. 8 illustrates a flow chart for a method of assessing a relationship of weight on bit that includes a determination of weight on bit induced side load torque using measurements of surface torque and differential pressure.

FIG. 8 illustrates assessing a relationship of weight on bit that includes a determination of weight on bit induced side load torque using measurements of surface torque and differential pressure. At 214, pressure is measured to determine a differential pressure across a mud motor while drilling. The measurement may be, for example, as described above relative to FIG. 3. At 216, a motor output torque is determined based on the differential pressure. In some embodiments, the torque at bit and motor output torque are assumed to be the same. The determination of torque at bit may be, for example, as described above relative to FIG. 3.

At 218, torque on the drill string at the surface may be measured during drilling. Torque on the drill string at the surface may be measured directly with instrumentation at the surface of the formation.

At 220, the off-bottom rotating torque is measured. In some embodiments, the off-bottom rotating torque is auto-sampled using a control system.

At 222, a weight on bit-induced side load is determined from the torque measurements and estimates. In one embodiment, an increase in torque due to weight on bit is determined using the following equation:

WOB-induced sideload torque=Surface torque (during drilling)−motor output torque−off bottom rotating torque At 224, an off-bottom friction factor is determined, from off-bottom rotating torque data. Weight-on bit and torque at bit may both be zero.

At 226, a WOB required to induce the weight on bit induced sideload torque is determined. The WOB is based on a torque and drag model using the off-bottom friction factor determined at 224. At 228, weight on bit estimates are used to control drilling operations.

Figure 8A:
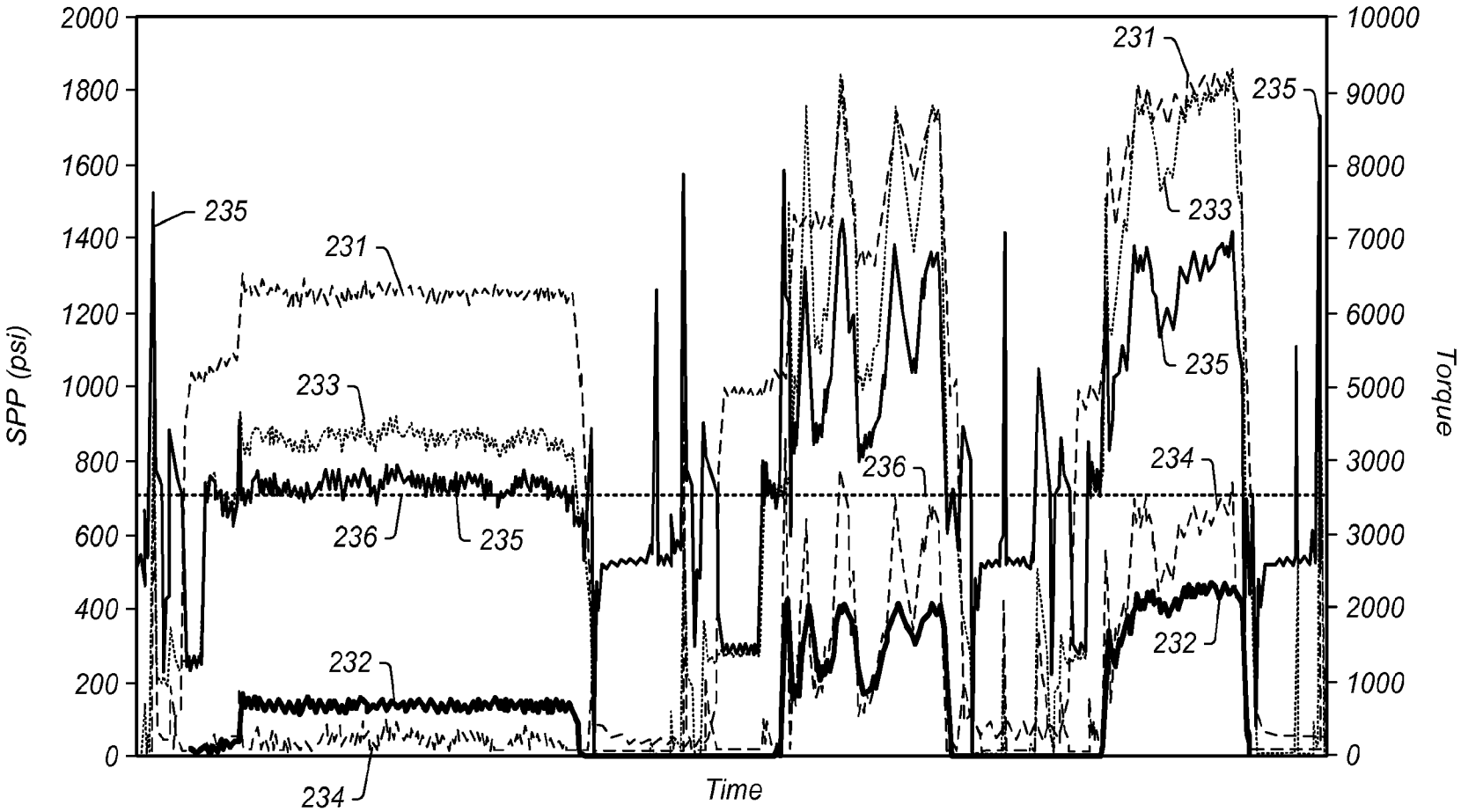
FIG. 8A illustrates a graph of rotary drilling showing measured and calculated torques over time.

FIG. 8A illustrates a graph of rotary drilling showing measured and calculated torques and pressures over time. Curve 231 shows standpipe pressure. Curve 232 shows motor torque. Motor torque may be determined from differential pressure calibration. Curve 233 shows measured surface torque. Curve 234 shows WOB induced sideload torque. WOB induced sideload torque may be calculated as described above relative to FIG. 8. Curve 235 shows string torque. String torque may the difference between surface torque and motor torque. Curve 236 shows off bottom surface torque.

In some embodiments, an automatic drilling operation is performed using differential pressure across a pump motor as the primary control variable. In some embodiments, a relationship between differential pressure across a pump motor and output motor torque is established using measurement of torque on a drill string at the surface of the formation, as described above with relative to FIG. 3. A control system may automatically monitor conditions, such as mud flow rate, WOB, and surface torque. In one embodiment, an automatic control system seeks a target differential pressure by increasing the rate of forward motion of a drill string into a hole as long as pre-defined conditions are met. The pre-defined conditions may be, for example, user-defined set points or ranges that may not be exceeded. Examples of setpoints include: WOB is within (user setpoint) of maximum WOB, Surface torque is within (user setpoint) of maximum torque, mud flow rate drops below (user setpoint) of target flow rate, torque instability exceeds (user setpoint), flow rate out differs from flow rate in by more than (user setpoint), stall is detected, hang up is detected, excess torque to drill detected, standpipe pressure differs from calculated circulating pressure by more than (user setpoint). In one embodiment, target differential pressure is 250 psi.

In an embodiment, directional drilling includes dropping by increasing a mud flow rate and building by decreasing an RPM and/or flow. In some embodiments, rotary drilling parameters are tuned to adjust inclination tune trajectory control for the laterals (without, for example, the need to resort to slide drilling.)

In an embodiment, individual subroutines in a PLC are incrementally joined together to enable full joints to be drilled autonomously with combinations of rotary and slide drilling. In certain embodiments, a bit is kept on bottom and low RPM drilling to synchronize the BHA toolface with surface position prior to slide drilling. This may allow a PLC to stop the BHA on toolface target and continue drilling in slide mode without needing to stop drilling or lift bit off bottom.

In some embodiments, a torque, drag, string windup, and hydraulic model is run live. The model may estimate the windup in the string and generate continuous toolface estimation to support autonomous control system while drilling at high Rate of Penetration (ROP). In certain embodiments, the model can generate output windup value at any time and fill the gaps between downhole updates. Hydraulic pressure may be calculated with required accuracy to get the motor torque. The weight on bit may also be obtained, for example, for mechanical specific energy ("MSE") analysis purposes.

In some embodiments, a friction factor may be determined from test measurements. For example, a friction factor may be established from motor output and torque measured at the surface. With input of drilling parameters such as RPM, ROP, surface rotary torque, surface hook load, the bit torque may be calculated. By matching the motor torque value with the calculated bit torque, an open hole friction factor can be determined (for example, by iterating to determine a value of a friction factor where the torques match). In some embodiments, weight on bit, torque along the string, and string windup are obtained, for example, by using the open hole friction factors measured automatically during off—bottom motions of the drill string. In certain embodiments, if friction factor is at or below a specified minimum value (such as 0.2) or at or above a specified maximum value (such as 0.7), drilling may be stopped and troubleshooting carried out.

Once the predicted down-hole WOB and the motor torque is available, torque as a function of the WOB may be computed, plotted, and displayed. In some certain embodiments, an MSE curve is determined and displayed. Drilling may be automatically performed using the calculated values, such as the calculated WOB. In some embodiments, friction factor may be recalculated as drilling is carried out and used in automatic drilling.

In one embodiment, a method of assessing a pressure used to form an opening in a subsurface formation includes measuring a baseline pressure when the drill bit is freely rotating in the opening in the formation. A baseline viscosity of fluid flowing through the drill bit is assessed based on the measured baseline pressure. As the drill bit drills further into the formation, the flow rate, density, and viscosity of fluid flowing through the drill bit are assessed. As drilling operations continue, the baseline pressure may reassessed based on the assessed flow rate, density, and viscosity of the fluid flowing through the drill bit.

Figure 9:
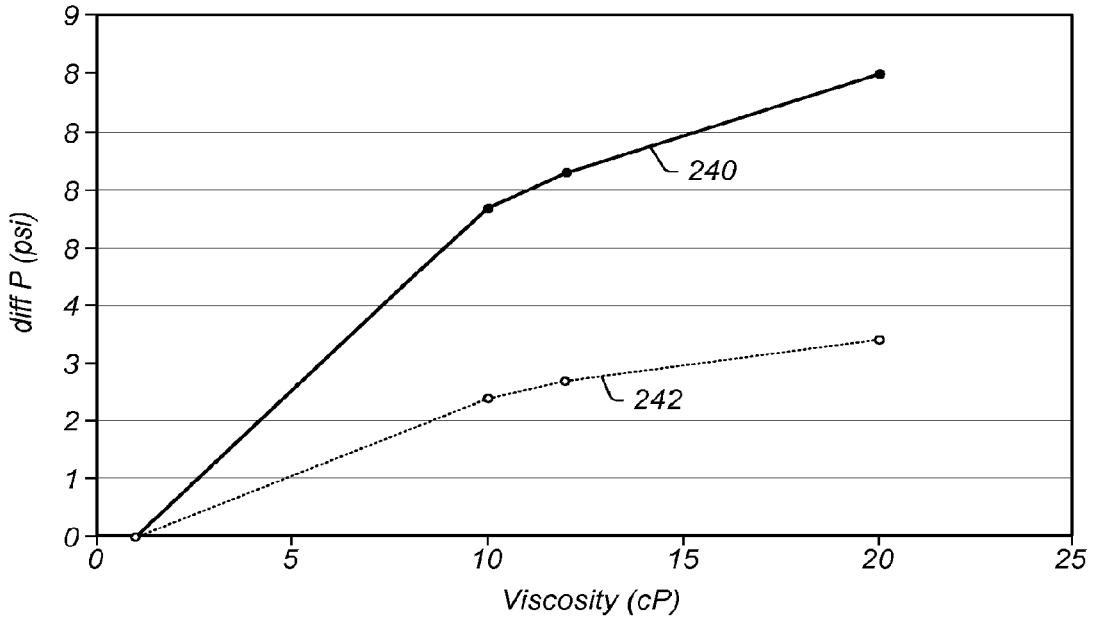
FIG. 9 illustrates a relationship between differential pressure and viscosity in a pipe.

In some embodiments, viscosity may be determined from differential pressure. In one embodiment, Coriolis flow meters are used to measure flow and density into and out of a well. Differential pressure is measured across a defined length of mud delivery line (which may be between the pump and drill rig of a drilling system). FIG. 9 illustrates a relationship between differential pressure and viscosity in a pipe. The example illustrated in FIG. 9 is based on a 20 m length of 2 inch mud delivery line. Curve 240 is based on a flow rate of 400 gallons per minute. Curve 242 is based on a flow rate of 250 gallons per minute.

Determining viscosity using differential pressure may eliminate the need for a viscosity meter. In some embodiments, however, a viscosity meter may be included in a drilling system.

In one embodiment, a drill bit is automatically placed on a bottom of the opening of a subsurface formation. Mud pumps are started and after a predetermined time the flow rate is ramped (at a predetermined rate) to the target flow rate. Flow rate of fluid into the drill string is monitored and controlled to be the same (within user limit setpoints) as the flow rate out of the well. Standpipe pressure is allowed to reach a relatively steady state. The drill string is rotated at a predetermined RPM. The drill bit is moved toward the bottom of the opening at a selected rate of advance until a consistent increase in measured differential pressure indicates that the drill bit is at the bottom of the opening. In some embodiments, this corresponds to bit depth=hole depth (cavings in the bottom of the hole or errors in depth measurement may, however, cause the "bottom" to be detected despite mismatch in the depth calculations). A number of set points may be established and variables monitored during the "lower bit to bottom" routine. The drill string rotation may be performed prior to mud pumps being engaged to reduce pressure when recommencing mud flow in the annulus. The drill bit may be backed off the bottom of the opening if the flow rate of fluid into the drill pipe is not substantially the same as the flow rate of fluid out of the opening.

During drilling operations, once drilling has progressed to the maximum available depth for a given length of drill pipe, the drilling rig is used to finish drilling and prepare to add another length of drill pipe.

In one embodiment, a drilling pipe is advanced into a formation. The advance of pipe is stopped (for example, when the maximum available depth for the length of drill pipe is reached). Differential pressure across a mud motor is allowed to decrease. In some embodiments, differential pressure is allowed to decrease to a user set point. Once the differential pressure has decreased to a prescribed level, the drill string may be picked up. A torque and drag model may be used to monitor the forces needed to perform the pickup. In one embodiment, the forces themselves can be predicted and used as alarm flags (if exceeded, for example, by a user defined amount). In another embodiment, the off bottom friction factor is used. For example, if the off bottom friction factor is over a specified amount (such as >0.5), a "tight hole pulling back" alarm condition may be triggered. Upon triggering of an alarm, a mitigation procedure may be commenced.

In an embodiment, the open hole friction factor is assessed during drilling. In certain embodiments, the open hole friction factor is continually assessed. For example, in embodiment, the open hole friction factor is continually assessed to verify that "normal" well bore conditions exist as a permissive for completion of the selected task(s). Error handling sub-routines may be defined to prevent and mitigate poor borehole conditions.

Mud motor stall is a common event. Typically, the power section of the motor contains a rotor that is driven to rotate by the flow of drilling fluid through the unit. The speed of rotation is controlled by fluid flow rate. The power section is a positive displacement system so as resistance to rotation (a braking torque) is applied on the rotor (from the bit), the pressure required to maintain the fixed fluid flow rate increases. Under various conditions, the capacity of the power section to keep the rotor rotating can be exceeded and the bit stops turning, i.e., a stall. A stall condition may sometimes occur within one second.

Figure 10:
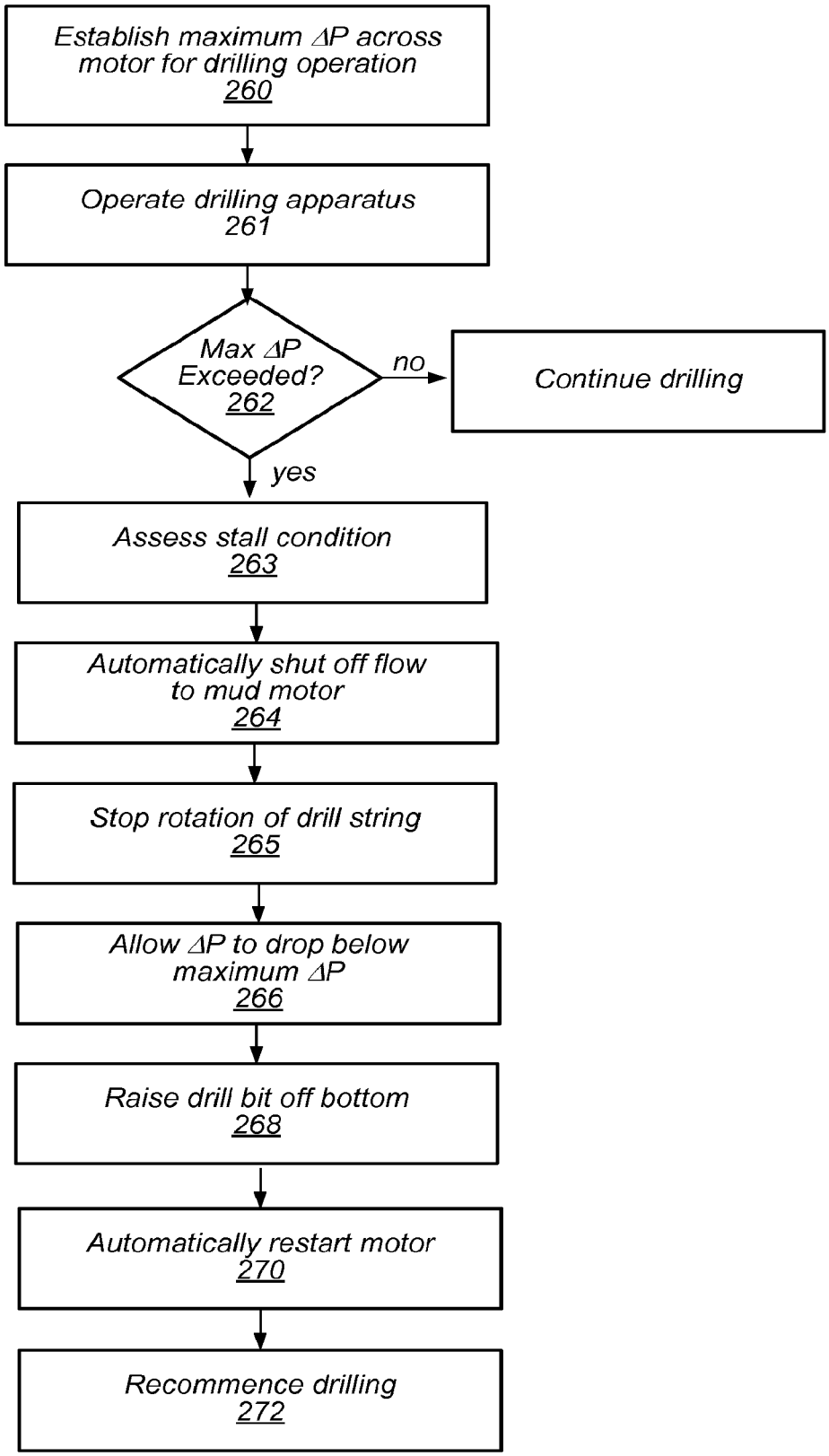
FIG. 10 illustrates a flow chart for a method of detecting a stall in a mud motor and recovering from the stall according to one embodiment.

FIG. 10 illustrates a method of detecting a stall in a mud motor and recovering from the stall according to one embodiment. At 260, a maximum differential pressure is set for the drilling operation. At 261, drilling may be commenced. At 262, differential pressure may be assessed. If the assessed differential pressure is at or above the assigned maximum differential pressure, a stall condition in the motor is assessed at 263.

Upon detection of a stall, flow to the mud motor is automatically shut off (for example, by turning off a pump for the motor) at 264. In some embodiments, rotation of a drill string coupled to the drill bit is automatically stopped at 265. In some embodiments, upon stall detection, drill pipe motion is automatically stopped (drill string forward motion reduced to zero). At 266, the differential pressure is allowed to drop below the assigned maximum differential pressure before allowing restart of the motor. In some embodiments, the excess pressure is bled off or allowed to bleed off. At 268, the drill bit may be raised off of the bottom of the well. At 270, the motor is restarted. At 272, drilling is re-commenced.

In one embodiment, off bottom stand pipe pressure is measured during drilling. A mud motor maximum differential pressure is assessed. A stall is indicated when the sum of the off bottom stand pipe pressure and the motor maximum differential pressure exceed a specified level. In one embodiment, stand pipe pressure is measured with a rig stand pipe pressure sensor.

Excessive build up of cuttings in a well during drilling may adversely affect a drilling operation. In an embodiment, mass balance metering of drilled cuttings is used to monitor conditions of a well. In some embodiments, the information from the mass balance metering is used to automatically perform drilling operations.

In some embodiments, a method of assessing hole cleaning effectiveness of drilling in a subsurface formation includes determining a mass of rock excavated in a well. The mass of cuttings excavated from the well can be determined, in one embodiment, by using an offset log, real time logging while drilling ("LWD") log, of formation bulk density. The length and diameter of hole may be used to provide the volume, and the bulk density log may provide the density estimate.

Figure 11:
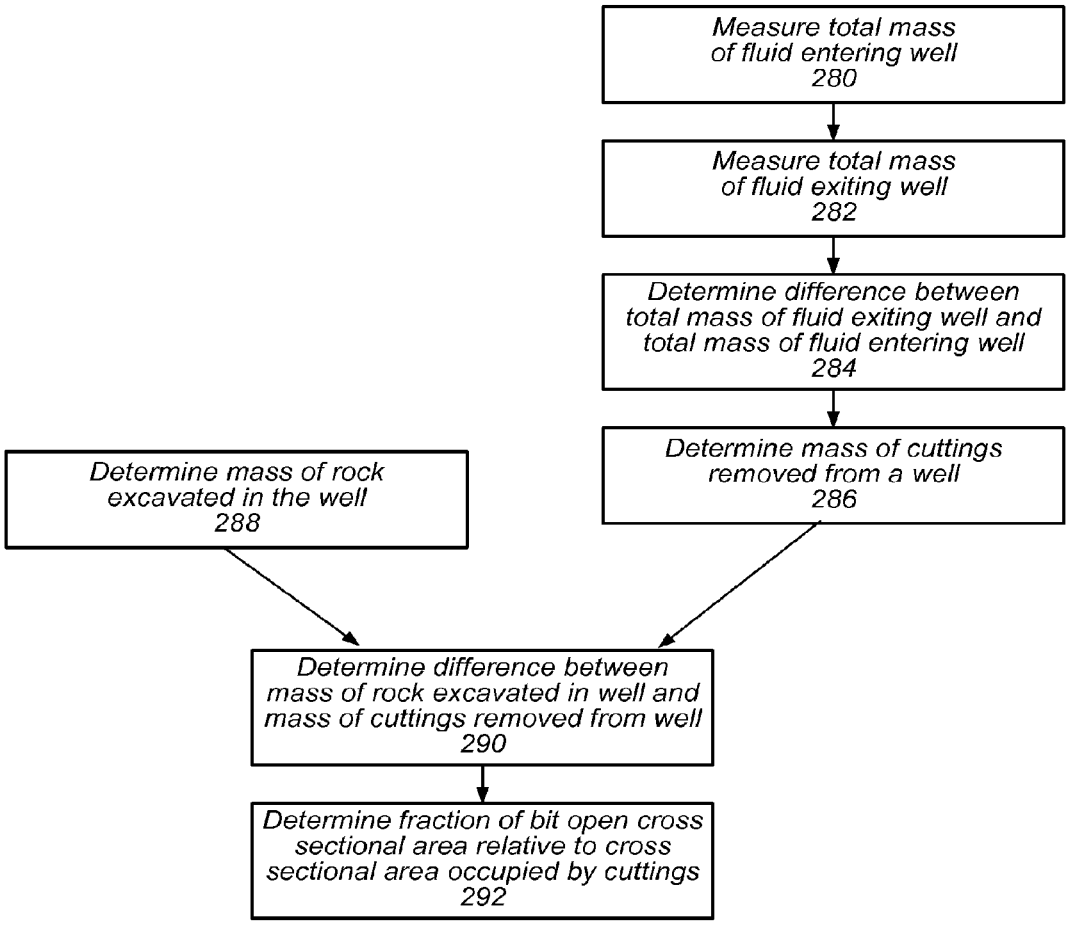
FIG. 11 illustrates a flow chart for a method of determining hole cleaning effectiveness.

A mass of cuttings removed from the well may be determined by measuring the total mass of fluid entering the well and the total mass of fluid exiting the well, and then subtracting the total mass of fluid entering the well from total mass of fluid exiting the well. The mass of cuttings remaining in the well may be estimated by subtracting the determined mass of cuttings removed from the well from the determined mass of rock excavated in the well. In certain embodiments, a quantitative measure of hole cleaning effectiveness may be assessed based on the determined mass of cuttings remaining in the well. FIG. 11 illustrates one embodiment of a method of determining hole cleaning effectiveness. Partial fluid losses may be taken into account by excluding the lost fluid mass from the reconciliation.

In some embodiments, continuous monitoring of drilling fluids density and flow rate is achieved using Coriolis mass flow meters. In one embodiment, Coriolis meters are provided at both the suction and return line to physically measure the mass flow of fluid entering and exiting the well in real time. The Coriolis meters may provide flow rate, density and temperature data. In one embodiment, a densimeter, flow meter, and viscometer are mounted inline (for example, on a skid placed between the active mud tank and the mud pumps). In one embodiment, a viscometer is a TT-100 viscometer. The densimeter, flow meter, and viscometer may measure fluid going into the well. A second Coriolis meter is installed at the flow line to measure the fluid exiting the well.

In some embodiments, a control system is programmed to provide an autonomous drilling and data collection process. The process may include monitoring various aspects of drilling performance. One portion of the control system may be dedicated to the processing of drilling fluids data. The control system may use drilling fluids data manual inputs, sensory measurements, and/or mathematical calculations to help establish indicators and trends to validate drilling performance in real time. In some embodiments, the data collected may be used to determine a Hole Cleaning Effectiveness.

In some embodiments, drilling fluid parameters are measured in real time. Real time measurements may also increase objectivity of the data to facilitate an immediate response to drilling fluid fluctuations. In some embodiments, density, viscosity and flow rate are measured in real time while drilling. Real time control and data collection of mudflow rate and density in and out of the well may enable accurate drilling parameter optimization. A control system may, for example, automatically react and make optimization adjustments based on sensor signals (with or without human involvement).

In some embodiments, mass balance metering of drilled cuttings is used to provide trend indication for hole cleaning effectiveness. In one embodiment, a mass balance calculation for a Hole Cleaning Index (HCI) is determined by calculating the volume of cuttings left in the well and making an assumption that all the cuttings are spread evenly along the horizontal section of the well. The cuttings bed height can be calculated and converted into a cross sectional area occupied by cuttings.

$$HCI = \text{Bit Open Area}/\text{Area Occupied by Cuttings}$$

The wellbore column of fluid may be independent of the surface system. Powder products or liquid additives transferred into the active system (if there are any such products or additives) may not have any bearing on the mass balance of fluid being circulated though the well in real time. The excavated drilled cuttings may thus be the only "additive" to the column of fluid. An exception to the assumption that drilled cuttings are the only additive would be if there is an influx of water from the formation. In some embodiments, water influx is determined by monitoring for any unexpected decrease in rheological properties measured from an inline viscometer. In other embodiments, totalizing of the volumes in versus volume out can indicate fluid influxes. The HCI may be adjusted based on any such decrease to account for the water influx.

In one embodiment, a Coriolis meter has a preset calibration schedule. The Coriolis meter may have built-in hi/low level alarms to confirm that accurate data is being received. In one example, a 6" Coriolis meter has two flow tubes, each having a diameter at 3.5" (88.9 mm). In one embodiment, the Coriolois meter controls the material flow to an accuracy of ±0.5 percent of the preset flow rate.

The use of automatic monitoring of cleaning effectiveness may eliminate or reduce a need for human monitoring of operations, such as monitoring of the shakers. For example, personnel may not be required at the shakers to measure viscosity and mud weight a periodic intervals. As another example, a mud engineer may not need to catch mud sample at periodic intervals.

Examples of mass balance monitoring are given below:

Example #1

Start Circulating

A suction meter and a flowline meter are read and assessed for balance. (There may be a slight discrepancy due to fluid temperature, in that the exiting fluid will be warmer therefore possibly slightly lighter.)

Fluid In/Out: 2 $m^3$/min×1040 kg/$m^3$=2080 kg/min

Inline fluid viscometer may measure at 600, 300, 200, 100, 6 and 3-rpm readings. The collection time may be 1 second at each rpm speed. 6 seconds to process all six readings.

A temperature correction may be made based a "look-up" table.

Example #2

Start Drilling

A mass of rock generated may be based on rate of penetration and hole size. The calculated mass of rock generated may be graphed in real time.

Hole Size @ 311 mm×ROP @ 100 m/hr=7.59 $m^3$ of cuttings excavated/hr (7.59 $m^3$/hr×2600 kg/$m^3$)/60 min=329 kg/min 2600 kg/$m^3$ may be an assumed value for the density of cuttings—alternatively, a density log "look-up" table from offset wells can be used to characterize density for each formation A look-up table may be provided that includes calliper log data from offset wells to increase accuracy.

A look-up table may be provided that includes a washout percentage vs depth from offset wells.

329 kg/min×5% washout=345 kg/min of rock being generated

A washout percentage may be graphed as a separate set of data points

The lag time may be computed based on the time it takes to empty the annulus of mud calculated from the annular volume and flowrate (a "bottoms up" time)

Cuttings shape, size, fluid slip velocity, horizontal vs vertical drilling may be assessed Example #3

Mass Balance

The total mass of fluid going into the well and total mass of fluid exiting the well are metered. The total mass of fluid going into the well is subtracting from the total mass of fluid exiting the well. The difference may indicate the mass of drilled cuttings removed from the well.

Fluid In: 2.0 $m^3$/min×1040 kg/$m^3$=2080 kg/min

Fluid Out: 2.0 $m^3$/min×1180 kg/$m^3$=2360 kg/min

The difference is 280 kg/min

By subtracting this difference from the actual mass of rock excavated, an indicator is obtained of a theoretical mass of drilled cuttings that has not been removed from the well.

Therefore 345 kg/min−280 kg/min=65 kg/min left in the well

In an embodiment, flow measurements may be used to set permissives in the control system. For example, a permissive may be set based on whether the flow coming out of the well is equal to flow going into the well within an established tolerance.

In some embodiments, performance of a mud solids handling system is monitored with the Coriolis metering system. Density and rate (mass flow) of slurry from the annulus of the well may be metered coming into the solids control system. The efficiency of the system in removing solids may be measured by the Coriolis meter on the other side of the system at the point where the mud enters the mud pump to be sent back down the hole. By tracking the base density of the mud against the density of the mud going back down the hole, the capacity of the system to remove the drilled solids is assessed.

In some embodiments, solids left in the well are determined. An overall solids control system performance is determined based on an overall removal of rock mass from both the well and the drilling fluid. The overall solids control system performance may provide an indicator as to how much cuttings are left in the well. In one embodiment, the measured mass of rock is plotted against theoretical mass of rock generated. The result may be displayed to an operator in a graphical user interface. In certain embodiments, a Maximum Solids Threshold Limit is established. The limit may be automatically displayed to a driller to provide the driller with a visual cue that the well is not adequately being cleaned. The limit may be linked as a setpoint to be monitored by an automated drilling control system. If the system determines that wellbore cleaning is inadequate, mitigation subroutines may be initiated such as reducing rate of penetration, increasing flow rate, increasing circulating time and rotary speed in the rpe and post joint drilling phases.

One challenge encountered in directional drilling is controlling the orientation of the drill bit, or bottom hole assembly ("BHA") toolface. As used herein, "BHA toolface" may refer to a rotational position in which the direction deflecting device (such as a bent sub) of a drilling assembly is pointed. In a bottom hole assembly including a bent sub, for example, the BHA toolface is always oriented off-axis from the attitude of the drill string at the end of the string. Commonly, when a section is drilled in a rotary mode of drilling, the BHA toolface continually changes as the drill string rotates. The aggregate result of this continually changing toolface may be that the direction of the bottom drilling is generally straight. In a slide drilling mode, however, the orientation of the BHA toolface during the slide will define the direction of drilling (as the BHA toolface may remain pointed generally in one direction over the course of the slide), and therefore must be controlled within acceptable tolerances. In addition, when changing from one drilling segment to another segment or from one drilling mode to another drilling mode, reestablishing BHA toolface may require substantial involvement of an operator and/or may require that the drill bit be stopped, both of which may slow the rate of progress and efficiency of drilling.

The challenge of controlling BHA toolface may be compounded by drill string windup. During drilling, the drill bit and the drill string are subjected to various torque loads. In a typical rotary drilling operation, for example, a rotary drive, such as a top drive or rotary table, is operated to apply torque to the drill string at the surface of the formation to rotate the drill string. Since the bottom hole assembly and lower portions of the drill string are in contact with the sides and/or bottom of the formation, the formation may exert counteracting, resistive torque on the drill string in the opposite direction as the rotary drive (e.g., counterclockwise, as viewed from above). These counteracting torques at the top and bottom of the drill string cause the drill string to twist, or "wind up", within the formation. The magnitude of the windup changes dynamically as the external loads imposed on the drill string change. In addition, the drill bit and the drill string may also encounter torque related to drilling operations (such as torque resisting rotation of the drill bit in the opening). In drilling systems where the angular orientation of the drill bit is used to control the direction of drilling (such as during slide drilling), drill string wind up may limit an operator's ability to control and monitor the drilling process.

One way to measure toolface direction is with downhole instrumentation (for example, a MWD tool on a bottom hole assembly). As with any measurement from a MWD tool, however, the toolface measurements may not provide continuous measurement of the toolface, but only intermittent "snapshots" of the toolface. Moreover, these intermittent readings may take time to reach the surface. As such, when the drilling string is rotating, the most recently reported rotational position of the toolface from the MWD tool may lag the actual rotational position of the toolface.

The rotational position of a drill string at the surface of a formation may be used to estimate the rotational position of the BHA toolface. In one embodiment, a rotational position of a BHA is correlated with a rotational position of a top drive rotating a spindle at the surface of a formation. For example, it may be established that under a particular condition, if the toolface is pointed up, then the rotational position of the top drive is at 25 degrees from a given reference. The process of correlating the rotational position of the BHA toolface with a rotational position at the surface of the formation is referred to herein as "synchronization". In some embodiments, synchronization includes dynamically computing a "Topside Toolface". The "Topside Toolface" at a given time may be the estimated rotational position of the toolface determined using the measured actual rotational position of the top drive, in combination with recent data on BHA toolface received from the MWD tool. Since the rotational position at the top drive is continually available, the Topside Toolface may be a continuous indicator of BHA toolface. This continuous indicator may fill the time gaps between the intermittent downhole updates from the MWD tool, such that better control of the toolface (and thus trajectory) is achieved than could be done with MWD toolface data alone. Once synchronized, the Topside Toolface may be used by a control system to stop the drill string with BHA toolface in a desired rotational position, for example, to conduct slide drilling.

In some embodiments, toolface synchronization is performed with the drill string at a specified RPM set point and a target motor differential pressure, while other drilling set points and targets are maintained.

In some embodiments, synchronization is based on BHA toolface data from a MWD tool. A gravity tool face ("GTF") value is received from the MWD tool. Synchronization may include synchronizing a BHA toolface with a rotary position at the surface of the formation. In certain embodiments, a Topside Toolface is used to predict where the BHA toolface value will fall when a value of the BHA toolface is received from the MWD tool. The lag time between downhole sampling of toolface and data decoding at surface may be accounted for by programming the lag time into a PLC or by measured and accounting for an RPM based offset (for example, by stopping the Topside Toolface early by the "offset" amount.) As noted above, once the toolface is synchronized, a programmable logic controller can stop the BHA toolface in a desired position to commence slide drilling.

Figure 12:
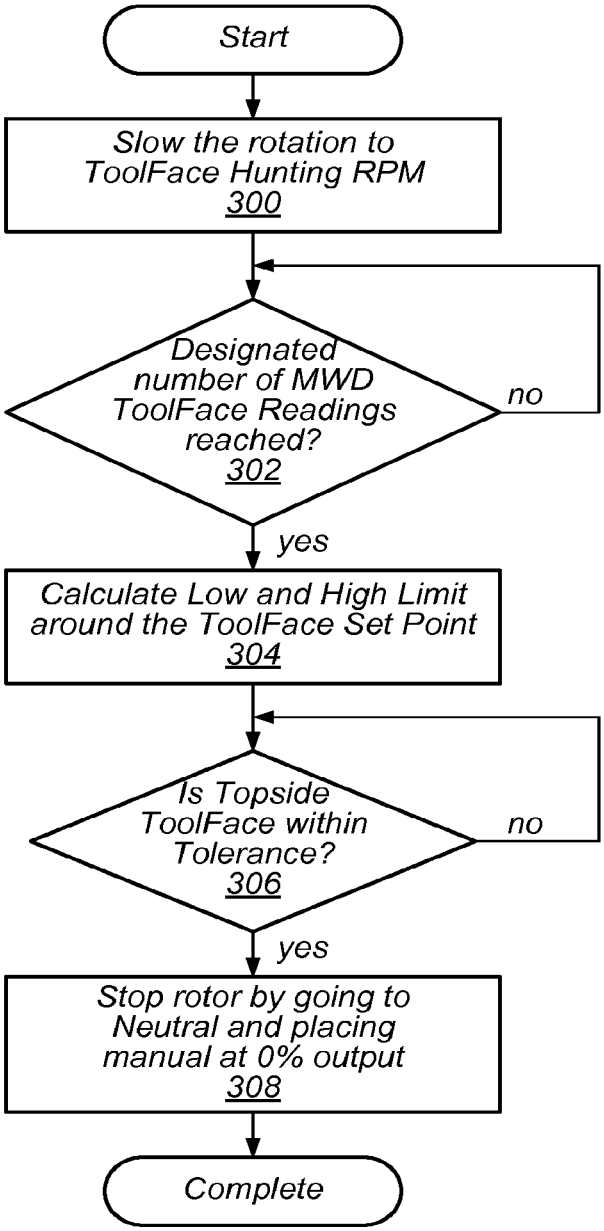
FIG. 12 illustrates toolface synchronization using measurement while drilling data according to one embodiment.

FIG. 12 illustrates toolface synchronization using MWD data according to one embodiment. At 300, the surface rotor may be slowed to a toolface-hunting RPM. At 302, reading of BHA toolface may be read from a MWD tool until a designated number of samples has been reached.

At 304, high and lower rotor position limits may be determined around a BHA toolface setpoint. In one embodiment, the angle offset between the desired toolface setpoint is calculated from models and/or the stable average of the last toolface readings. The Low Desired Toolface Setpoint and High Desired Toolface Setpoint Limit may be determined from the desired MWD toolface. Topside Toolface (a rotational position) may be calculated based on current rotary position and the calculated angle offset.

At 306, an assessment is made whether the Topside Toolface is within the established tolerance. If the Topside Toolface is not within the established tolerance, the rotor may continue to turn at the hunting RPM. Topside Toolface may be reassessed until the Topside Toolface comes within the established tolerance. When the Topside Toolface is within the established tolerances, the drill string may be stopped by going to neutral at 308. In some embodiments, a BHA toolface synchronization such as described above is used in transition from rotary drilling to slide drilling. In other embodiments, a BHA toolface synchronization may be used in a stop drilling routine. In certain embodiments, toolface synchronization is used when a drilling system is pulled back to the "stop" level to position the MWD at the same rotational position each time, which may minimize the roll dependent azimuth measurement variation.

In some embodiments, a drilling operation is carried out in two modes: rotary drilling and slide drilling. As discussed above, rotary drilling may follow a relatively straight path and slide drilling may follow a relatively curved path. The two modes may be used in combination to achieve a desired trajectory. In some embodiments, a drill bit may be kept on the bottom and rotating (at full speed or a reduced speed) during an automatically controlled transition from one drilling mode to another (such as from rotary to sliding, or sliding to rotary). In some embodiments, the bit may be kept on bottom and rotating (at full speed or a reduced speed) during an automatically controlled transition from one segment to another (such as from one slide segment to another slide segment). Continuing to drill during transitions may increase the efficiency and overall rate of progress of drilling. In one embodiment, a carriage drive (such as a rack and pinion drive) of a drilling rig provides force to maintain motor differential pressure at the target level. In other embodiments, the weight of the drilling tubulars within the well bore provides the force as the drilling rig drawworks allows the string to feed into the well bore.

In some embodiments, controlling a slide drilling operation includes dynamic tuning of the BHA toolface. In some embodiments, dynamic tuning is carried out during transition from a rotary drilling mode to a slide drilling mode. For example, to start a transition to a slide drilling mode, rotation of the drill string may be slowed to a stop. As rotary drilling is slowed to the stop, the BHA toolface may be synchronized. Once the BHA toolface is synchronized, the BHA toolface may be tuned (using, for example, holding torque applied at the surface of the drill string) to maintain the BHA toolface at a desired rotational position during slide drilling and using surface rotation to adjust the holding torque up or down intermittently to effect a change in the BHA toolface.

In some embodiments, a drilling system is prepared for slide drilling by synchronizing the BHA toolface and "topside toolface" to allow drill string rotation to be stopped when the BHA toolface is in the required position. Once the BHA toolface is stopped in the required position, unwinding the drill string may be performed to reduce the surface torque to the required holding torque. Once the drill string is unwound, the BHA toolface may be maintained with a holding torque imparted by a rotary drive system at the surface of the formation.

Figure 13:
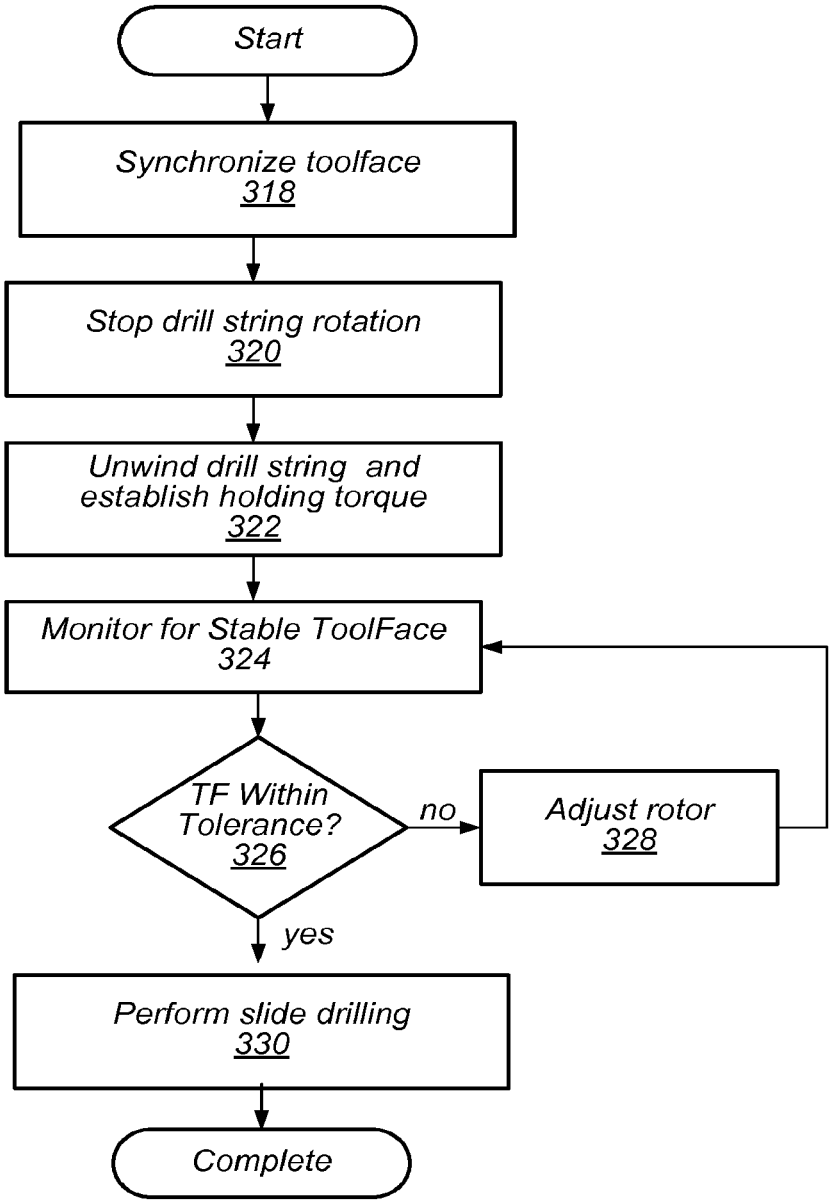
FIG. 13 illustrates a flow chart for a method of a transition of a drilling system from rotary drilling to slide drilling.

FIG. 13 illustrates a transition of a drilling system from rotary drilling to slide drilling. In this embodiment, the transition includes dynamic tuning of a BHA toolface. At 318, the BHA toolface is synchronized. In one embodiment, synchronization may be as described above relative to FIG. 12. In some embodiments, during or after synchronization, the rotary drive is stopped such that the BHA toolface is within tolerance of a desired rotational position setpoint.

In some embodiments, during toolface synchronization, differential pressure across a mud motor operating the drill bit (which may correlate to TOB and/or WOB) is brought up to and/or maintained at a target setpoint for slide drilling. In other embodiments, differential pressure may be at a level other than the target differential pressure for slide drilling. In certain embodiments, differential pressure across the mud motor is controlled as a function of BHA toolface. In one embodiment, if BHA toolface is within a range of a target setpoint, then differential pressure may be set to a slide drilling differential pressure setpoint. In some embodiments, differential pressure across the mud motor may begin at a reduced set point (such as 25% of slide drilling target differential pressure) and then be allowed to increase (for example, in predetermined increments) based on offset from a BHA toolface target.

At 320, the rotary drive may be stopped with the BHA toolface at the desired setpoint. At 322, the drill string may be unwound. Unwinding may be as fast as is practical for the drilling system. In some embodiments, unwinding may be based on a torque and drag model that includes string windup. In other embodiments, unwinding may be based on surface torque. In some embodiments, the string is unwound to a neutral holding torque. In other embodiments, the string may be unwound to a left roll holding torque. As used herein, "left roll holding torque" may be equal to bit torque as calculated form differential pressure minus a user-defined BHA "Left Roll Holding Torque" variable. A left roll holding torque may be suitable, for example, if a system tends to stop with BHA toolface rolled too far to the right.

For the initial transition to slide drilling from rotary drilling, if left roll holding torque is being held, the BHA toolface roll may be monitored. If the BHA toolface is rolling right (forward), the BHA toolface will start rolling backwards as long as there is negative torque at the surface. The more negative torque, the faster BHA toolface should stop and come backwards. The BHA toolface may also be rotated backwards ("left") or forwards ("right") with differential pressure changes.

If the BHA toolface is rolling left (backward), by contrast, the rotary may be rotated neutral holding torque (bit torque) as soon as the projected BHA toolface hits tolerance.

The BHA toolface is unlikely to be stable initially. If the BHA toolface is stable for a long period, a failure alarm may be triggered.

At 324, the controller may monitor for stable BHA toolface. At 326, if the BHA toolface moves out of tolerance, the rotary drive at the surface may be adjusted to bring the BHA toolface back within tolerance.

In certain embodiments, a holding torque is about equal to the mud motor output torque as computed using a differential pressure relationship. The surface holding torque is increased/decreased by surface rotation to maintain the equivalent torque as output by the mud motor, unless toolface changes down hole are required. In one example, an increase in motor output torque of 200 ftlb may require a forward rotation at the surface of 45 degrees before a surface torque increase of 200 ftlb is measured. The topside toolface may remain the same during the adjustment of holding torque.

In an embodiment, a control system automatically reduces the target differential pressure during a transition from rotary drilling to slide drilling Once slide drilling is established, the control system may automatically resume the original target differential pressure.

Monitoring of BHA toolface may be based on measurements from downhole instrumentation, surface instrumentation, or a combination thereof. In one embodiment, monitoring of BHA toolface is based on a downhole MWD tool. In one embodiment, delta MWD toolface ("DTF") rate is monitored. If the BHA toolface moves out of the tolerance window, a surface rotor may be adjusted at 328. For a given rate of penetration, the DTF may be fairly constant for a given right roll holding torque. As the BHA rolls in response to left roll holding torque, the surface torque will go down. Surface torque may be maintained with rotation to hold left roll holding torque and the DTF rate. The left roll holding torque is dynamic (based on bit torque), so if the motor torque increases due to formation change, left roll holding torque target in the PLC may require surface clockwise rotation (this surface clockwise rotation would counter a tendency for the BHA toolface to roll left.) As soon as the BHA toolface rolls into the tolerance window (based on projecting the last measured DTF forward in time), surface torque may be returned to neutral holding torque (which may be the same as bit torque as calculated from differential pressure) by rotating the rotary drive at the surface.

At 330, slide drilling may be performed. The controller may monitor for stable BHA toolface, and the rotary drive may be adjusted to maintain the BHA toolface in a desired rotational position. As discussed above, in some embodiments, drilling may continue throughout the transition from a rotary drilling mode to a slide drilling mode.

In some embodiments, once the BHA toolface has settled into the window (based on DTF) with surface torque equal to neutral holding torque, the string can optionally be automatically wiggled, wobbled or rocked to mitigate drag. Tweaking of BHA toolface can be done by rotating the required increment at the surface, holding position and allowing the torque at surface to return naturally to the holding torque.

Table 1 is an example of user setpoints for tuning.

| Setpoint | Example setting |
|---|---|
| Toolface sync RPM | 5 |
| Initial slide drilling DiffP % of maximum | 60 |
| DiffP resume rate | 1 minute |
| Toolface tolerance + | 10 |
| Toolface tolerance − | 10 |
| LRT 1 | 500 ftlb |
| LRT 2 | 750 ftlb |
| LRT 3 | 1000 ftlb |
| RRT 1 | 500 ftlb |
| RRT 2 | 750 ftlb |
| RRT 3 | 1000 ftlb |
| Toolface sync stop rotary TTF offset | −30 deg |

In one embodiment, to adjust the rotor to return the BHA toolface to the setpoint, the rotor may be turned until the current rotor Topside Toolface (TTF) is within tolerance of the Desired Toolface. As used in this example, Topside Toolface refers to the down hole MWD toolface transpose to the topside rotary position. The Topside Toolface may make use of the last good MWD toolface reading and the current rotary position. For example, if the drill string is wound up and the last toolface was 30 degrees from the Modeling setpoint, the topside rotary position may be rotated 30 degrees in the direction that the drill string is wound up.

In some embodiments, a tuning method includes slowing a rate of progress, reducing the drill string RPM at the surface to zero, unwinding to a user defined "unwind torque" (which corresponds to a negative holding torque), and pausing between surface adjustments based on projected BHA toolface that takes DTF into account versus time. As the projected BHA toolface comes into the required range, the surface rotary position may be adjusted to resume neutral holding torque. As shown in FIG. 4, the greater the negative or positive holding torque (in that case indicated by torque at drive sub), the greater the rate of change in DTF (see the rate of change in BHA right roll). In certain embodiments, the relationship between the magnitude of the negative/positive holding torque and the rate of change in DTF is mapped automatically.

Figure 14:
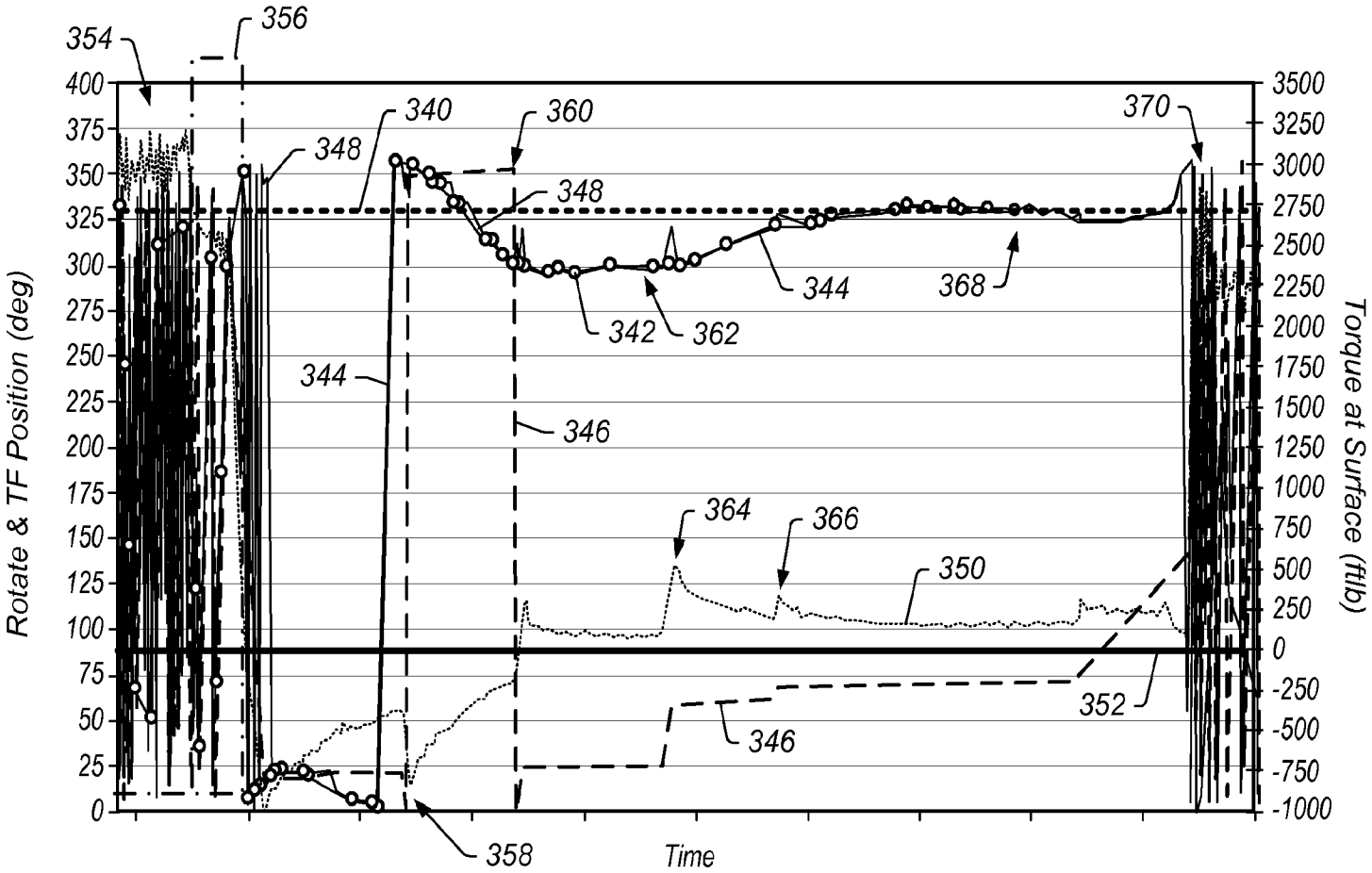
FIG. 14 is a plot over time illustrating tuning in a transition from rotary drilling to slide drilling with surface adjustments at intervals.

In some embodiments, a tuning method includes making two more adjustments to a surface rotor to achieve a desired BHA toolface. Between each adjustment, the rotor may be paused until the BHA toolface stabilizes. FIG. 14 is a plot over time illustrating tuning in a transition from rotary drilling to slide drilling with surface adjustments at intervals. Curve 340 represents a toolface target. Points 342 represent readings from a gravity toolface (for example, from an MWD tool). Curve 344 is a curve fit of points 342. Curve 346 represents the rotational position of an encoder on a rotary drive. Curve 348 represents a Topside Toolface. Curve 350 represents surface torque. Curve 352 represents zero torque.

Initially at 354, the drilling system is operated in a rotary mode. At point 356, toolface synchronization is commenced at 5 rpm. At 358, a reverse rotate adjustment is made. At 360, a forward rotate adjustment is made. At 362, the BHA is stable and surface torque may equal bit torque. At 364 and 366, forward rotate adjustments are made. At 368 the BHA is again stable and surface torque may be equal to bit torque. At 370, the drilling system may re-enter a rotary drilling mode.

Figure 15:
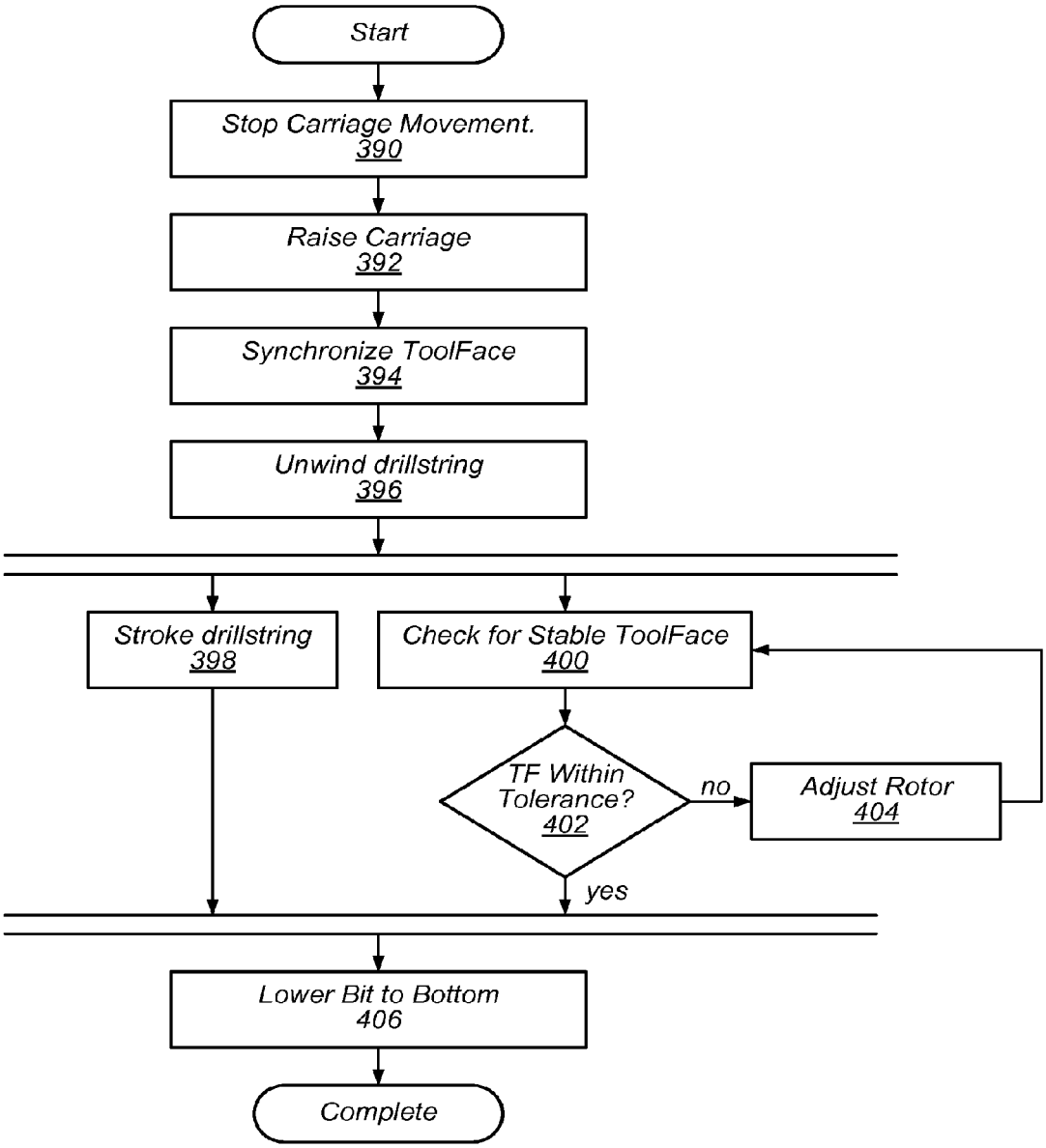
FIG. 15 illustrates a flow chart for a method of a transition from rotary drilling to slide drilling including carriage movement according to one embodiment.

In some embodiments, a carriage or other drill string lifting system may be controlled (for example, raised and lowered during a transition from rotary drilling to slide drilling FIG. 15 illustrates a transition from rotary drilling to slide drilling including carriage movement according to one embodiment. At 390, carriage movement of a drilling system is stopped. At 392, the carriage may be raised (for example, to bring the drill bit of the system off-bottom). In one embodiment, the carriage is raised about 1 meter.

At 394, the BHA toolface is synchronized. In one embodiment, synchronization may be as described above relative to FIG. 12. The rotary drive may be stopped with the BHA toolface at the desired setpoint. At 396, the drill string may be unwound. Unwinding may be as described above relative to FIG. 13.

At 398, the drill string may be stroked while checking for a stable BHA toolface. A stroke may include raising and then lowering the carriage by an equal amount (such as two meters up and two meters down). The controller may monitor for stable BHA toolface at 400. At 402, if the BHA toolface moves out of tolerance, the surface rotor may be adjusted at 404 to bring the BHA toolface back within tolerance.

At 406, the drilling bit may be lowered to the bottom of the formation. In some embodiments, the BHA toolface may be lowered to bottom a predefined angle to the right of the target BHA toolface. This may allow the BHA toolface to walk to the left as bit torque increases during drilling. In some embodiments, monitoring and tuning as described at 402 and 404 may be continued as slide drilling is carried out.

In some embodiments, a method of controlling drilling directions includes automatically rotating a drill string at multiple speeds during a rotation cycle. In certain embodiments, drilling at multiple speeds in a rotation cycle may be used in a course correct procedure. For example, drilling at multiple speeds in a rotation cycle may be used to nudge the path of the hole back into line with a straight section of the well. In one embodiment, automatically rotating a drill string at multiple speeds is used as a course correct following a straight ahead lateral.

Figure 16:
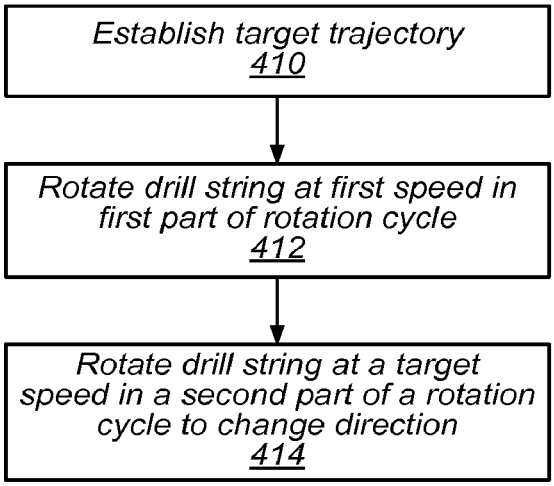
FIG. 16 illustrates a flow chart for a method of an embodiment of drilling in which the speed of rotation of the drill string is varied during the rotation cycle.

FIG. 16 illustrates an embodiment of drilling in which the speed of rotation of the drill string is varied during the rotation cycle. At 410, a target trajectory is established. At 412, during drilling operations, a drill string is rotated at one speed during one portion of the rotation cycle. At 414, the drill string is rotated at a second, slower speed during another, "target" portion of the rotation cycle. Slower rotation in the target portion of the rotation cycle may bias the direction of drilling in the direction of the target portion.

In some embodiments, the sweep angle of the target portion of the rotation cycle is equal to the sweep angle of the other portion of the rotation cycle (i.e., 180 degrees in each portion). In other embodiments, the sweep angle of the target portion of the rotation cycle is unequal to the sweep angle of the other portion of the rotation cycle. In one example, the slower, target speed is ⅕ of the initial speed for the rotation cycle. However, various other speed ratios and angular proportions may be used in other embodiments. For example, a target speed may be ⅙, ¼, ⅓, or some other fraction of the initial speed. In certain embodiments, the speed of a rotor may vary continuously over at least a portion of a rotation cycle. In certain embodiments, a rotor may rotate at three or more speeds during a rotation cycle.

Figure 17:
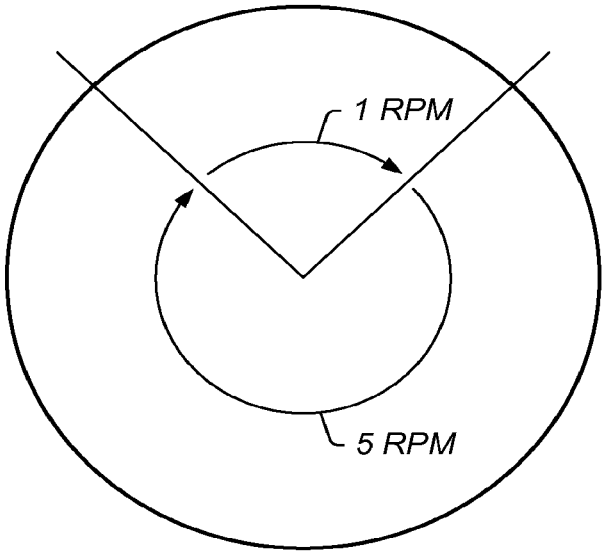
FIG. 17 illustrates a diagram of a multiple speed rotation cycle according to one embodiment.

FIG. 17 illustrates a diagram of a multiple speed rotation cycle according to one embodiment. In the example shown, the rotor speed is 5 RPM for 270 degrees of the rotation cycle, and 1 RPM for the remaining 90 degrees of the rotation cycle.

In some embodiments, a desired turn rate is achieved based on rotor speeds and sweep angles. In one example, a turn rate is estimated as follows:

Assumptions:

At a target range is 90 degrees (+/−45 degrees of intended angle change direction), a net half the build rate may be expected in the average target range direction. If the motor pulls 10 deg/30 m with full slide, the net would be 5 deg/30 m.

RPM is 5 and 1, 270 deg at 5 rpm (30 deg/sec), then 90 deg at 1 rpm (6 deg/sec).

In the target range, the BHA dwells for 15 seconds while on the opposite side, the BHA takes 3 seconds to traverse the opposite target range. The discount on 5 deg/30 m is thus 3/15×5=1 deg/30 m. Any meters drilled in one orientation may be counteracted by meters drilled in the opposite orientation.

Based on the preceding calculations, 4 deg/30 m would be the expected build rate. This build rate is further reduced, however, because there are two toolface quadrants to be traversed outside the target and backside that also do not contribute to net angle change. In particular, for 6 second per revolution or 6 seconds per 24 seconds the BHA is in the left or right from target quadrant so 6/24×4 deg/30 m=1. This yields an expected build rate of 3 deg/30 m using a 10 deg/30 m sliding BHA, which translates, for example, to 0.2 deg angle change if the procedure was employed for 2 m out of a 9.6 m joint.

Minimum curvature is commonly used in is calculating trajectories in directional drilling Minimum curvature is a computational model that fits a 3-dimensional circular arc between two survey points. Minimum curvature may, however, be a poor option if the sample interval used to take surveys does not capture the tangent points along the varying curvature. Ideally, surveys would be taken each time the drilling was changed from rotary drilling to slide drilling or each time that the toolface orientation of the BHA was changed. Such repeated surveying would be time consuming and costly.

In an embodiment, attitudes (azimuth and inclination) at the known points along a wellpath may be used, in combination with the rotary drilling angle change tendency, to estimate the attitudes at the start and end points of the slide drilled section without the need for extensive surveys. The rotary drilling angle change tendency is determined by observing the change in drilling angle as measured during a preceding section of rotary drilling. The estimated attitudes can be used as "virtual" measured depths to better represent the actual path of the borehole and therefore improve position calculation.

In one embodiment, a method of predicting a direction of drilling of a drill bit used to form an opening in a subsurface formation includes assessing a depth of the drill bit at one or more selected points along the wellbore. An estimate is then made, based on the assessed depths, of the attitudes at the start and end points of each slide drilled section. For slide drilled sections contained within the measured surveys, virtual measured depths, with attitude estimates, are assessed by projecting from a current survey back to one or more previous measured depths. These virtual measured depths, in some embodiments, may be used to evaluate the slide drilling dogleg severity ("DLS") and toolface performance (for example, where the trajectory of the well actually went compared to where the BHA was pointed). The rotary drilling dogleg severity and toolface performance may also be evaluated based on sampling sections of hole drilled entirely in rotary mode that contain at least two surveys.

In some embodiments, a projection to bit is refreshed based on drilling mode and sampled DLS tendencies each time a measured depth is updated. In certain embodiments, a projection back to the previous measured depth is made to install virtual measured depths, with attitude estimates, for slide drilled sections contained within measured depth boundaries.

In some embodiments, the path of a borehole made using a combination of rotary drilling and slide drilling is estimated using a combination of actual survey data (such as from downhole MWD tools) and at least one drilling angle change tendency established during rotary drilling. For example, if a borehole is formed by rotary drilling, slide drilling, and rotary drilling in succession, an angle change tendency while rotary drilling is initially determined (for example, using survey data). A directional change value (such as a dog leg angle) is determined for the slide drilled section based on actual surveys (for example, using actual surveys that flank the slide drilled section). The directional change value of the slide drilled section may be adjusted based on the flanking surveys. The adjusted directional change value may account, for example, for any portion between the actual surveys that was rotary drilled and for the angle change tendency during such rotary drilling. A net angle change across the slide drilled section may be determined using previously determined project ahead data (which may include, for example, the attitudes at the start and ends of the slide). A projection to bit value may be refreshed using the net angle change. The refreshed projection may be used to estimate the path of the borehole, for example, as part of a "virtual" continuous survey.

Figure 18:
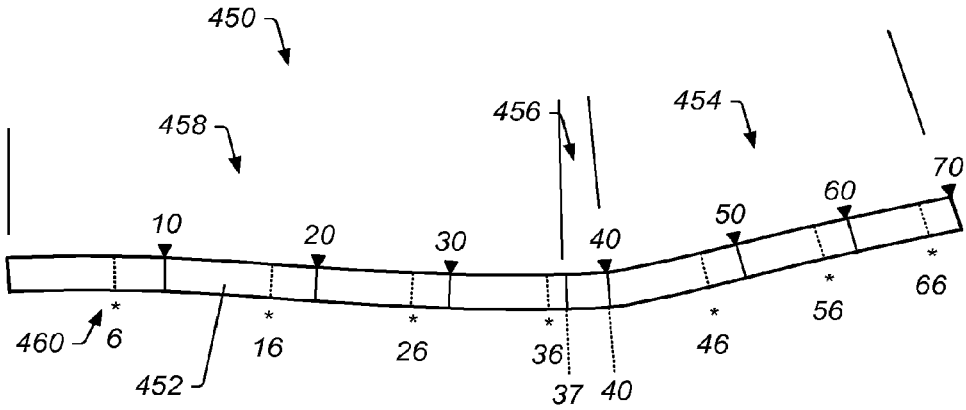
FIG. 18 illustrates a drill string in a borehole for which a virtual continuous survey may be assessed.

FIG. 18 illustrates a schematic of a drill string in a borehole for which a virtual continuous survey may be assessed. In FIG. 18, drill string 450 includes drill pipe 452. Drill string 450 has been advanced into a formation. Portion 454 has been advanced using rotary drilling, portion 456 has been advanced by slide drilling, and portion 458 has been advanced by rotary drilling. Stations 460 (marked by asterisks) are the survey ("measured") depths. The survey depths correspond to the position of the MWD sensor behind the bit. For this example, distance between the bit and MWD sensor is around 14 meters so, for example, as the bit is drilled to 20 m, the MWD sensor just arriving at 6 m. As the bit is drilled to 30 m (assume 10 m drill pipe lengths) the MWD sensor just arrives at 16 m. The first three joints are rotated to 30 m. At this time, there are 30 m of rotated hole and 2 full sample intervals of rotary drilling. Surveys at 6 m and 16 m, along with previously taken surveys, are all taken in the hole that has been rotary drilled. The rotary drilling angle change tendency can be determined by analyzing the drift (e.g., attitude) in the position of the MWD sensor for at least three surveys. In one embodiment, the first and last survey are used to determine the change in attitude during rotary drilling, this change in attitude can be used to determine the rotary drilling angle change tendency. For purposes of this example, the rotary drilling angle change tendency during drilling was determined to be 0.5 deg/30 m @ 290 deg.

For this example, the last 3 m of joint 4 is slide drilled. This takes the hole depth from 37 m to 40 m. The next two joints are rotary drill to take the hole depth to 60 m. At this point the bit is at 60 m, the MWD sensor is at 46 m, and a slide drilled section is contained within the depth interval of 36-46 m.

The dogleg angle ("DL") and toolface ("TF") for the slide drilled section may be calculated using the actual surveys that straddle the slide drilled section. In the context of the surveys described relative to FIGS. 18-18C, "toolface" refers to the effective change in the direction of a hole. For purposes of the surveys described in FIGS. 18-18C, "TFO setting offset", or "Toolface Offset Offset" refers to the difference between the direction the motor (for example, the bend on a bent sub motor) was pointed and where the hole actually went. For purposes of this example, the values for the actual survey are as shown below:

| Meas. Depth | Inclination | Azimuth | Dogleg | DLS | Toolface |
|---|---|---|---|---|---|
| 36 | 90 | 45 | | | |
| 46 | 94 | 47 | 4.47 | 13.41 | 26.49 |

The dogleg angle due to rotary drilling angle change tendency, over 7 m at 0.5 deg/30 m @ 290 can be determined as 7/30*0.5=0.12 deg @ 290

0.12 at 290 degrees can be considered as representing a polar coordinate.

This value may be converted to rectangular coordinates

| Dogleg | Toolface | X | Y | Dx | Dy |
|---|---|---|---|---|---|
| 4.47 | 26.49 | 1.9938 | 4.0007 | | |
| 0.12 | 290 | −0.113 | 0.041 | 2.107 | 3.960 |

Dx and Dy may be converted back to polar coordinates:

Based on the foregoing calculations, the slide drilled section had an angle change of a dogleg angle of 4.49 deg at toolface of 28.01.

From the original project ahead data, a net angle change across the slide drilled section may be determined, for example, by taking the Start slide drilling inclination and azimuth and the Start rotation drilling again inclination and azimuth and then using these values to calculate a net dogleg angle and toolface.

The projection may be refreshed. Assuming that the projection estimate was that the slide drilling DL was 0.5 @ 045 deg, a refreshed projection based on 30/3×4.49=44.9 deg/30 m. The Toolface offset is about 45−28=17 deg.

The recalculated projection may now approximate the attitude at 46 m as the measurement from the MWD.

In certain embodiments, goal seeking may be performed to make projection DL the same as the actual (measured) DL by changing an original sliding DLS prediction. In certain embodiments, goal seeking may be performed to make Projection Toolface Offset ("TFO") the same as the actual (measured) TFO by changing TFO setting offset. In some embodiments, "virtual surveys" are inserted into the survey file. In one embodiment, the virtual survey may be used to assess performance for a slide drilling BHA.

Example

Non-limiting examples are set forth below.

Figure 18A:
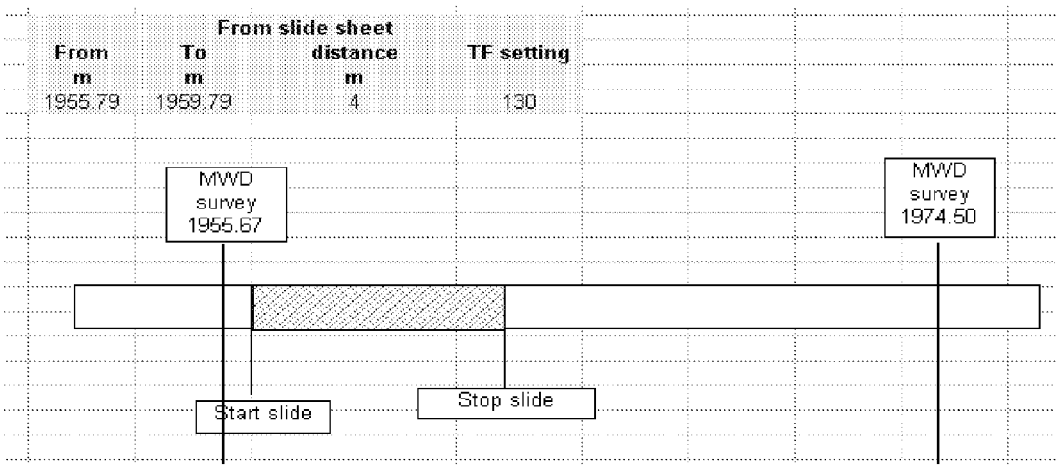
FIG. 18A depicts a diagram illustrating an example of slide drilling between MWD surveys.

FIG. 18A depicts a diagram illustrating an example of slide drilling between MWD surveys. In the example illustrated in FIG. 18A, a 4 m slide is carried out from a survey depth of 1955.79 to 1959.79, at a toolface setting of 130. The net angle change between the 1955.67 m survey and the 1974.5 m survey was determined to be 0.75 degrees and the direction of the angle change was determined to be 90.00438 degrees relative to hiside (at 1955.67 m). For this example, in the original projection ahead, the dog leg severity for the slide drilling section was 12 degrees/30 m and the TFO setting offset was −10 degrees. The dog leg severity for rotary drilling was 0.6 degrees/30 m at a toolface setting of 290.

Based on the foregoing information, the dogleg caused by the slide drilled section and effective toolface offset of the angle change that occurred in the slide drilled section were determined as follows: Goal seeking was carried out to make projection dogleg equal to actual (MWD) dogleg by changing the original sliding dog leg severity prediction. Based on the dogleg goal seek, the dogleg severity for the slide was reduced to 7.83 degrees/30 m. Goal seeking was then carried out to make Projection Toolface Offset equal to actual (MWD) toolface offset by changing the Toolface Setting Offset. Based on this TFO goal seek, the dogleg severity was further reduced to 7.7517 degrees/30 m and the TFO setting offset was changed to −34.361511 degrees. New points representing the start and end of the slide section were then determined to produce two virtual surveys.

FIG. 18B is tabulation of the original survey points for this example. FIG. 18C is tabulation of the survey points for this example with the two new virtual survey points added in rows 460. In addition, in FIG. 18C, the trajectory estimate for the end survey position at 1974.5 m has been updated in cells 462 (compared to the values in corresponding cells 464 for the original end survey position at 1974.5 m shown in FIG. 18B.)

In certain embodiments, an updated Toolface offset offset and new estimate for sliding dogleg severity are used for real time project to bit and steering calculations.

Vertical appraisal wells can provide some top elevation data concerning a formation. Unfortunately, horizontal well MWD survey elevation data may have a higher uncertainty than the thickness of the oil production well "sweet spot" (for example, a 4 m-thick sweet spot with a +/−5 m MWD survey). In addition, from structure contours built up from horizontal well MWD data, significant variance may be encountered.

In some embodiments, a true vertical depth ("TVD") is assessed using measurement of fluid density. In one embodiment, a method of assessing a vertical depth of a drill bit used to form an opening in a subsurface formation includes measuring downhole pressure exerted by a column of fluid in a drill pipe. The density of the column of fluid is assessed based on a density measurement at the surface of the formation (for example, with a coriolis meter on the suction side of a mud pump). A true vertical depth of the drill bit may be determined based on the assessed downhole pressure and the assessed density. The true vertical depth is used to control subsequent drilling operations to form the opening. In some cases, a control system automatically adjusts for variations in mud density within the system.

In some cases, TVD measurement data is used to control jet drilling.

In one embodiment, a method for determining true vertical depth includes installing a coriolis meter as a slipstream on the outlet of the mud tank. A pressure gauge of optimum range and accuracy may be coupled to an MWD tool. A pressure transducer is installed in the MWD tool. A density column is modeled in a PLC to account for mud density variation in the time taken to fill the build section. Internal BHA pressure is sampled. The internal pressure may transmitted to the surface and/or stored. In one embodiment, the pressure signature of "pumps off" is detected (see, for example, FIG. 19) and the static fluid column pressure is measured and reported to the surface PLC such as at 502.

In one embodiment, the pressure exerted by a column of fluid inside a drillpipe is recorded using a pressure sensor (attached, for example, to the end of the MWD apparatus inside a first nonmagnetic collar). The density of the column of fluid may be measured with a Coriolis meter on the suction side of a mud pump. Real time, full steam density may be measured on the suction line of the pumps using, for example, a +/−0.5 kg/m3 accuracy Coriolis meter. The data sets may be used to calculate TVD. In one embodiment, internal pressure at the BHA is recorded using, for example, a +/−0.5 psi pressure transducer.

Figure 19:
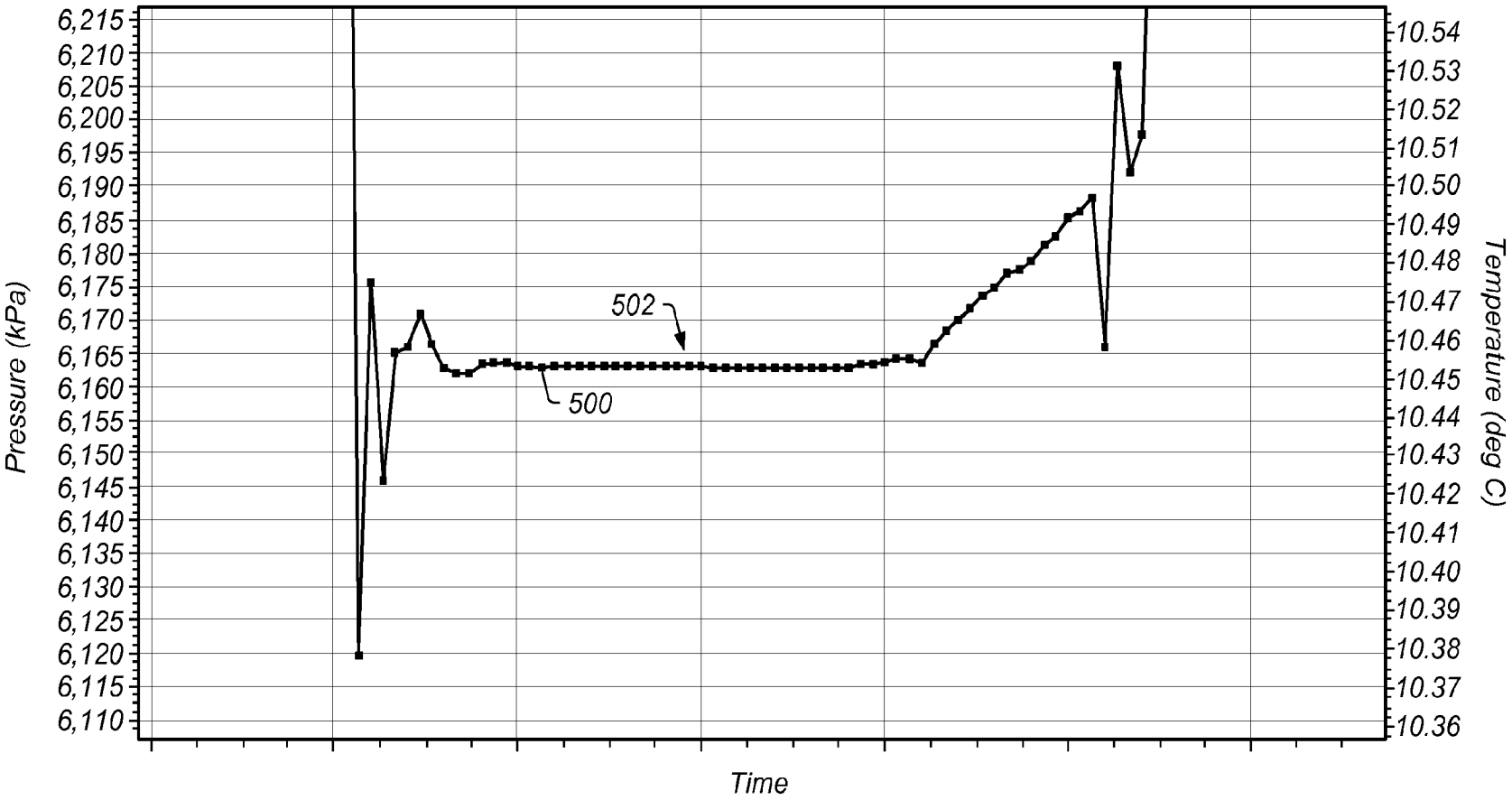
FIG. 19 illustrates an example of pressure recording during adding of a joint lateral according to one embodiment.

FIG. 19 illustrates an example of pressure recording during "pumps off" adding of a joint of drill pipe according to one embodiment. In the example shown in FIG. 18, the flat-line pressure was extracted along with mud density data to calculate the vertical height of the fluid column Curve 500 is a plot of pressure recorded during connection. The flat section at 502 represents a full and stationary string of fluid with the top drive disconnected waiting for the next joint to be added.

Figure 20:
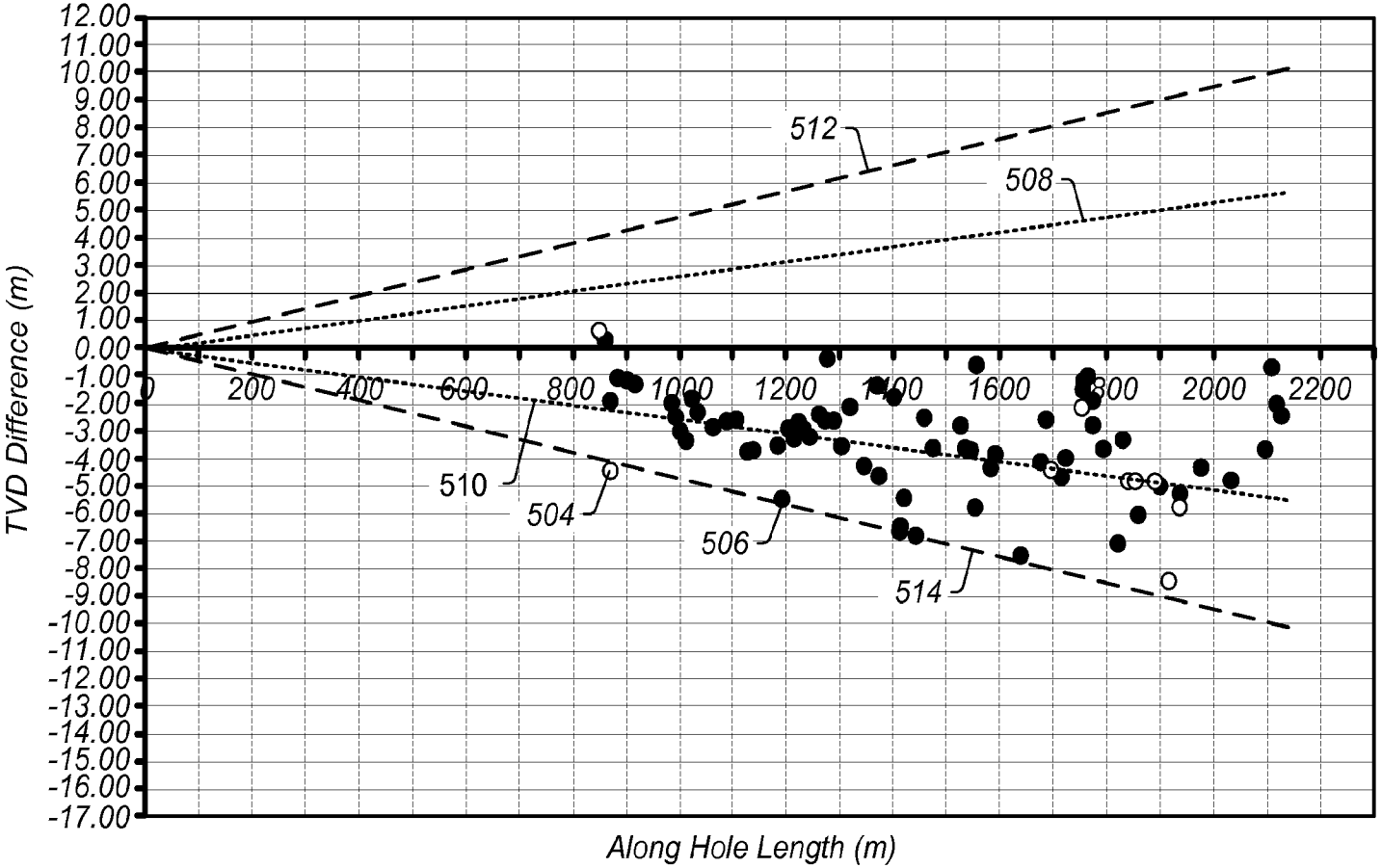
FIG. 20 illustrates an example of density total vertical depth results.

FIG. 20 illustrates an example of density TVD results. Set of points 504 and set of points 506 each correspond to a different lateral. Lines 508 and 510 (positive and negative TVD, respectively) correspond to a curve fit of the data. Lines 512 and 514 (positive and negative TVD, respectively) correspond to a 2 sigma ISCWSA standard survey. The density TVD data obtained in this example may resemble magnetic ranging position calculations. Each value is unique and not subject to the cumulative error that might be obtained using systematic MWD inclination measurement error. The longer the horizontal, the greater may be the advantage of TVD based on density over MWD TVD assessment. For example, as reflected in FIG. 20, the cloud of data for TVD based on density may have only about half the spread of the 2 sigma ISCWSA MWD standard survey model.

A best fit using this data set suggests the actual location of the well path is equivalent to a 0.15 deg systematic inclination measurement error below the calculated position.

In some embodiments, a compensation may be made, in a density TVD calculation, for one or more of the following sources of error: (1) contaminated pressure measurements from imperfections/deficiencies in float sub use/design; (2) malfunctioning mud pump charge pumping system and cavitation bubbles causing density measurement noise; and (3) mud density variation not taken into account in the build section. In one embodiment, the density TVD measurement is used to verify position in hole for handling down hole tools or at critical depths such as tangents in the wellpath.

MWD tools often include sensors that rely on magnetic effects. The large amount of steel in a bottom hole assembly may cause significant error in MWD survey data. One way of reducing this error is to space the MWD tool a significant distance (such as 16 meters) away from the major steel components of the BHA. Such a large spacing between the BHA and the MWD sensors may, however, make directional steering much more difficult, especially in horizontal drilling. In some embodiments, a calibration procedure is used to measure and account for the interference on Bz of a bottom hole assembly. In one embodiment, a method of measuring and accounting for magnetic interference from a BHA includes: (1) measuring the pole strength of the steel BHA components; (2) recording MWD grid correction/declination/Btotal & Bdip measurement locally with a site roll-test with tool on a known alignment, (3) calculating the Bz interference at the chosen nonmagnetic spacing; (4) using the planned wellpath geometry to plan spacing requirements, (5) applying an offset (during drilling or post drilling) allowing for the known interference to MWD Bz measurements; and (6) recalculating the azimuth using modified Bz measurement. In some embodiments, BHA components may be degaussed.

In some embodiments, inertial navigation sensors such as fibre optic gyros may be used for drilling navigation. Optical gyro sensors may, in some cases, replace magnetic sensors, thereby alleviating the interference effects of steel in a BHA.

A method of steering a drill bit to form an opening in a subsurface formation includes using real-time project to bit data. The real-time data may be, for example, data gathered between periodic updates ("snapshots") from a measurement while drilling (MWD) tool on a bottom hole assembly. In one method, a survey is taken with the MWD tool. The survey data from the MWD tool establishes a definitive path of the MWD sensor. The attitude measured at the sensor is used as a starting point from which to project the attitude and position of the drill bit in real-time. The real-time projection to bit may take into account drilling parameters as toolface values recorded against sliding intervals. When a subsequent survey is taken with the MWD tool to produce a new definitive position and attitude, the real-time project to bit is updated based on the new definitive path and the values used for toolface offset offset and sliding dogleg severity are updated for subsequent projections to bit.

In some embodiments, trajectory calculation is based on surveys (such as quiet surveys collected while adding drill-pipe to the string). The survey data may be collected by direct link to the MWD interface hardware/software. The data may be attached to the Measured Depth as generated by bit depth value−Bit lead value. The trajectory calculation may be treated as a "definitive" path for the purpose of drilling a hole.

In some embodiments, the system automatically accumulates a database. In the database, the intervals drilled with rotation and the intervals drilled sliding may be recorded. The intervals drilled sliding may be updated each time toolface data point is received from the MWD. The toolface value is recorded against that sliding interval.

As drilling of the next joint is prepared, the definitive path updates to as close as it ever gets to the bit (hole depth−bit lead).

As a definitive path updates prior to commencing a new joint of drilling, the project to bit calculation may update as follows:

(1) If the section ahead of the bit is all rotation, the attitude at the bit is estimated accordingly.

(2) If there is slide drilling in the section ahead of the sensor, the attitude may be estimated by accumulating dl (differential length) at the received toolfaces over the recorded intervals.

(3) Attitude change may be accumulated to the current bit position taking into account all toolface v. interval steps and rotary drilling sections.

The real time project attitude to bit may be used for a real time bit position calculation (which may be tied onto the last definitive path position point).

Figure 21:
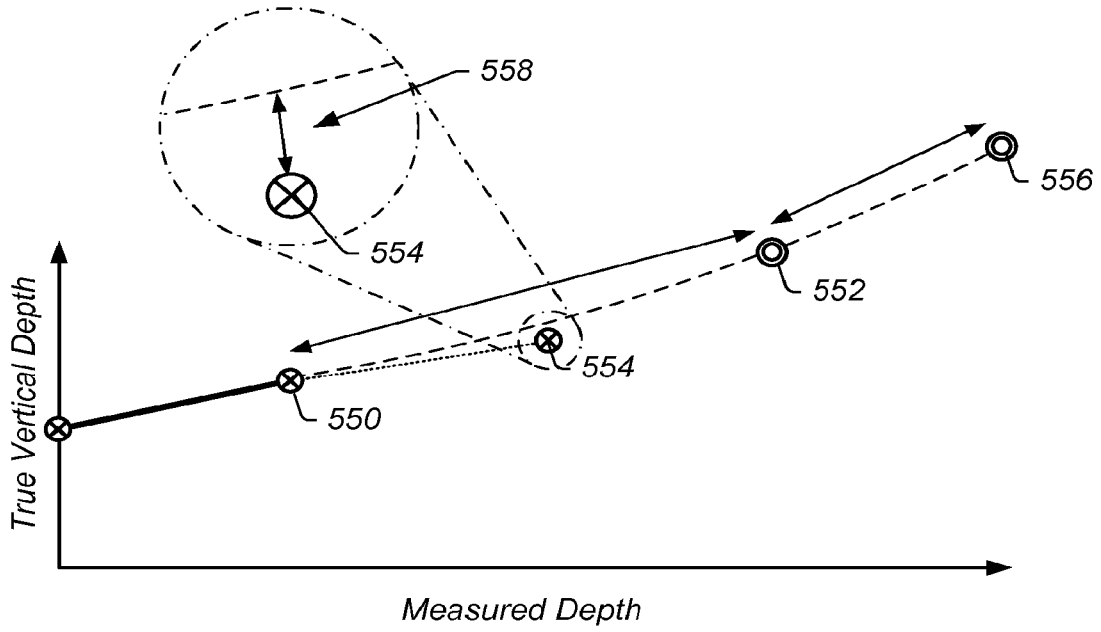
FIG. 21 illustrates is a graphical representation illustrating a method of performing a project to bit.

FIG. 21 is a plot of true vertical depth against measured depth illustrating one example of a project to bit. Point 550 is a previous definitive inclination point. Point 552 is a projected inclination point. Point 554 is an "about to receive" definitive inclination point. Point 556 is a new projected true vertical depth (TVD) point. For a 15 m bit lead, the project to bit starts at 15 m distance as the system begins to drill a new joint. The project to bit extends out to 15 m+joint length just before the next quiet survey is received. In one embodiment, a non-rotating sensor housing may be used. Difference 558 represents an error projection. In some embodiments, the error projection is tracked for inclination and azimuth for the attitude at the bit (for example, position up/down, left/right).

A method of steering a drill bit to form an opening in a subsurface formation using an optimum align method includes taking a survey with a MWD tool. The survey is used to calculate the hole position. A project to bit is determined (for example, using best-fit curves). The project to bit is used in combination with an optimum align method to maintain the drill bit within a predetermined tolerance of a drilling plan.

In one embodiment, implementation of steering in a PLC includes taking a survey and adding the survey to a calculated hole position. A project to bit is performed (using for example, best fit curves for build up rate ("BUR") or toolface results, or a rotary vector). Formation corrections (such as elevation triggers/gamma triggers) and drilling corrections (toolface errors, differential pressures out of set range) may be applied. In certain embodiments, learned knowledge may be accounted for (for example, a running average of BUR) when correcting best fit curves. A bit projection may be added to the survey. A project ahead may be determined.

Slide records may be maintained in a database manually or automatically. As the driller performs slide and rotate intervals, the system may automatically generate slide records. These records may also be entered and edited by a user. Slide records may be recorded with Time, Depth, Slide (Yes/No), Toolface and DLS. Slide records have two main functions: (1) to project from the last survey to the end of the hole (the project may be a real time calculated position of the end of hole; and (2) to analyze the sliding performance.

In certain embodiments, a system includes a motor interface. The motor interface may be used after tests have been performed (for example, a pressure vs. flow rate test) and an adequate number of samples have been captured. From the tests, trend lines (such as pressure vs. flow rate) may be generated.

In an embodiment, a method of generating steering commands includes calculating a distance from design and an angle (attitude) offset from design. The angle offset from design may represent the difference between what the inclination and azimuth of the hole actually is compared to the plan. The angle offset from design may be an indication of how fast the hole is diverging/converging relative to the plan. In some embodiments, distance from design and an angle (attitude) offset from design are calculated in real time based on the position of the hole at the last survey, the position at the projected current location of the bit, and the projected position of the bit (e.g., a project ahead position).

In certain embodiments, a tuning interface allows a user to adjust the steering instructions, for example, by defining setpoints in a graphical user interface. In certain embodiments, tuning controls may be used to establish a "look-ahead" distance for computing steering instructions.

Figure 22:
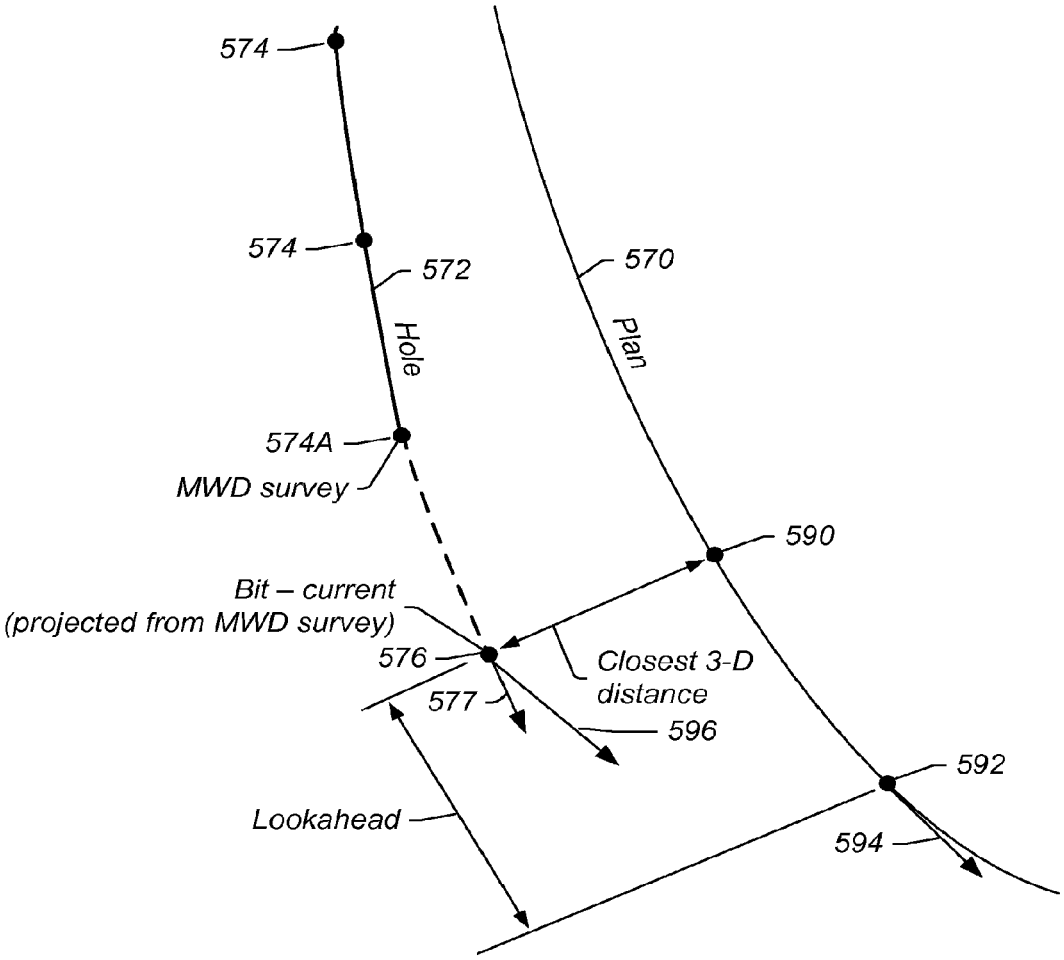
FIG. 22 is a diagram illustrating one embodiment of a plan for a hole and a portion of the hole that has been drilled based on the plan.

FIG. 22 is a diagram illustrating one embodiment of a plan for a hole and a portion of the hole that has been drilled based on the plan. Plan 570 is a curve representing the path of a hole as designed. Plan 570 may be a line from start to finish of a well that defines the intended path of the well. Hole 572 is a curve representing a hole that has been partially drilled based on plan 570. MWD survey points 574 represent points at which actual surveys are taken as hole 572 is drilled. The actual surveys may be taken using MWD instruments such as described herein. MWD surveys at each of MWD survey points 574 may provide, for example, a position (defined, for example, by true vertical depth, northing, and easting components) and attitude (defined, for example, by inclination and azimuth). As previously discussed, MWD instrumentation may be up hole (such as about 14 meters) from bit 576.

Point 576 represents a projected position of the end of a drill bit being used to drill the hole. Line 577 represents an attitude of the bit at point 576.

In certain embodiments, from the last MWD survey, the angle of a hole is calculated to the current bit position based on a slide table. If the hole is rotary drilled to the current bit location from the last MWD survey, the projection may use the rate of angle change (dogleg severity) in a particular toolface direction that is selected for rotary drilling. In some embodiments, a controller uses the automatic BHA performance analysis values for rotary drilling dogleg severity and direction. In other embodiments, a controller uses manually entered values. Once the rate and direction of the curve that the BHA will follow is defined, the system may track the bit depth in real time and perform vector additions of the angle change to maintain a real time estimate of inclination and azimuth at the bit.

A similar method may be used for slide drilling, with, in some cases, an additional user setup step of defining where the sliding toolface will be taken from. For example, the sliding toolface may be taken from real time updates from the MWD, or from a toolface setting defined prior to drilling the joint (for example, a controller may calculate that a 5 m slide with toolface set at 50 degrees is required).

In certain embodiments, a topside toolface setting may be used to determine the projected bit position. A topside toolface might be used, for example, for a system having a slow MWD toolface refresh rate.

Figure 23:
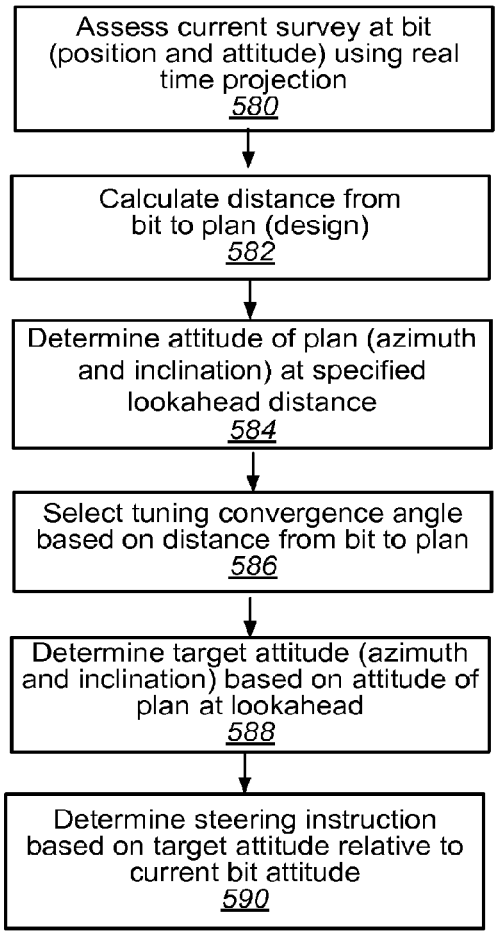
FIG. 23 illustrates one embodiment of a method of generating steering commands.

FIG. 23 illustrates one embodiment of a method of generating steering commands. A method of generating steering commands may be used, for example, in making a hole such as the hole shown in FIG. 22. At 580, a current survey at a bit for an actual hole being drilled is determined. The survey may include a position and attitude of the bit. In some embodiments, a current survey may be used to project a future position of a bit in real-time, for example, from actual MWD survey data. For example, with reference to FIG. 22, a current position for bit 576 may be projected from a MWD survey taken at most recent MWD survey point 574A.

At 582, a distance from the determined position of the bit to planned (designed) position of the bit is determined. In some embodiments, a three dimensional "closest approach" distance of the bit from the plan is calculated. (A closest approach plan point is shown, for example, at point 590 shown in FIG. 22.) From the three dimensional closest approach distance calculation, the depth of the planned pathway ("depth on plan") that corresponds to the three dimensional point is determined. Using the depth on plan value, the planned position and attitude values, such as plan inclination, azimuth, easting, northing, and TVD at the determined depth on plan point may be calculated (by interpolation, for example). The calculated position and attitude values may be used to calculate the changes in the toolface to return the hole back to the planned position.

A direction from the current bit location back to the planned bit position may be calculated. For example, the toolface from the plan point to bit (determined from the three-dimensional closest approach) may be determined. The reverse direction, the toolface from bit back to plan, may also be determined.

At 584, an attitude of the plan (azimuth and inclination) is determined at a specified lookahead distance. (A lookahead point on a plan and corresponding attitude are shown, for example, at point 592 and attitude 594 shown in FIG. 22.) In some embodiments, the inclination and azimuth are interpolated at the lookahead distance. The specified distance may be, for example, a user-defined distance. In one embodiment, the lookahead distance is 10 m. The project ahead for the lookahead may be determined in a similar manner as used to project the survey at a projected bit position.

At 586, a tuning convergence angle is determined based on distance from bit to plan. The tuning convergence angle may be, in certain embodiments, the angle that the toolface is altered to bring the bit back to the planned position. In some embodiments, the tuning convergence angle varies based on bit three-dimensional separation from plan.

In certain embodiments, a convergence angle may be determined on a sliding scale. The table below gives one example of a sliding scale for determining a tuning convergence angle.

| 3D Separation (m) | Tuning convergence angle (degrees) | Notes |
|---|---|---|
| <0.5 | 0 | May reduce the steering to allow convergence |
| >0.5 m <1 m | 1 | Steer for convergence |
| >1 m <2 m | 2 | Stronger steer tendency |
| >2 | 3 | May require relatively severe correction |

At 588, a target attitude (azimuth and inclination) is determined. The target attitude may be based, for example, on the attitude of the plan at the lookahead distance. In some embodiments, the target attitude is adjusted to account for a tuning convergence angle, such as the tuning convergence angle determined at 586.

At 590, one or more steering instructions are determined based on the target attitude relative to current bit attitude determined at 588. In some embodiments, a steering solution matches an angle as determined at the lookahead distance, plus an additional convergence angle required at that lookahead position. (A direction for a steering instruction is represented, for example, at arrow 596 shown in FIG. 22.)

In some embodiments, once a target angle has been defined at the lookahead distance, the toolface required to get there and the length of slide drilling needed are calculated (for example, at the defined dogleg severity for the sliding motor performance). In one embodiment, a dogleg and TFO required are calculated between a current survey at bit and a target inclination/azimuth. Using input sliding dog leg severity expectation, a slide length to achieve the required dogleg may be calculated. The toolface may be calculated as, for example, a gravity toolface or a magnetic toolface. In certain embodiments, a controller automatically uses a magnetic toolface when bit attitude has an inclination less than 5 degrees. In some embodiments, dogleg severity/toolface response values are fixed, for example, by a user. In certain embodiments, BHA performance analysis automatically generates a steering solution required to respond to the output.

Figure 24:
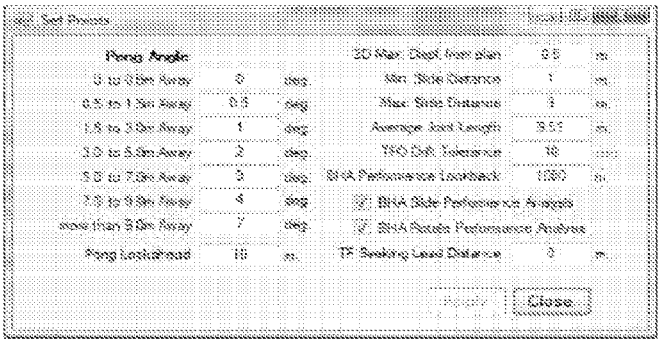
FIG. 24 illustrates one embodiment of a user input screen for entering tuning set points.

In some embodiments, a PLC incorporates a sliding scale of steering control response through setpoint tuning parameters. The further (distance) the hole is away from design, the larger the convergence angle may be used to calculate as a course correction. FIG. 24 illustrates one embodiment of a user input screen for entering tuning set points. The tuning angle of convergence may be used as the angle of convergence back to plan. For example, when the hole is close to plan, the PLC may put "zero convergence" into the lookahead to generally maintain a parallel trajectory. As the hole gets further away, the system may increase the convergence angle depending on how far away the hole gets from the plan. For example, when 0-0.5 m away from plan, the system may look at the angle of the plan 10 m further on from current bit position and use that inclination and azimuth, plus 0 degree convergence angle, to determine if a steer is required. If 0-3 m away from plan, the system may look at the angle of the plan 10 m further on from current bit position and use that inclination and azimuth, plus a 1 degree tuning convergence angle, to determine if a steer is required.

In certain embodiments, additional tuning criteria of minimum and maximum slide distance may be established a command to be passed through to the PLC. For example, based on the setpoints shown in FIG. 24, only slides greater than 1 m or less than 9 m slides may be allowed.

In some embodiments, while drilling, surveys are captured and projections are made to the end of the hole. The control system may calculate the point at which a slide should be performed. Set points may direct the calculations to tell the system when to slide and for how long.

Inputs may include one or more of the following:

- 3D Max Displacement from Plan—Defines the maximum displacement from plan that the well bore is allowed to go before the controller provides a correcting slide.
- Min. Slide Distance—Restricts the minimum slide length, ignoring required slides that are less than this value.
- Max. Slide Distance—Restricts the maximum slide length.
- Average Joint Length—Estimate of the average joint length.
- TFO Drift Tolerance—Allow the slide drilling to continue with the current TF when the live MWD TF drifts from the desired TF.
- BHA Performance Lookback—Distance up the hole to analyze the BHA performance.
- BHA Slide Performance Analysis—Option to calculate the slide performance in real time
- BHA Rotate Performance Analysis—Option to calculate the rotate performance in real time
- TF Seeking Lead Distance—Issues the command to go into slide mode early by specified depth.

In some embodiments, the information describing the current borehole location and the directional drilling requirements to get back to a plan are provided in the control system in the form of drilling directives. The directives are automatically calculated as each joint is completed. The user has the option to leave the calculated results or modify them. Under ideal conditions, the user will simply leave this screen alone. And each subsequent joint will automatically update as the drilled joint is completed.

Drilling directives may be used to instruct the drilling sequence to be performed for the next joint. The directives may be automatically calculated as each joint is completed. Each subsequent joint may automatically update as the drilled joint is completed.

In some embodiments, tuning of steering decisions may be accomplished by radial tuning. Radial tuning may include, for example, keeping within a given distance from design which is the same in any up/down–left/right direction. In other embodiments, tuning may be used to implement "rectangular" steering decisions. In one example of rectangular steering, the lateral position specification for the bit path is allowed to be greater than the vertical position. For example, the bit may be allowed to be 10 m right of design but kept vertically within 2 m offset from design.

In some embodiments, a set of limiting setpoints are established based on geosteering. The geosteering-based setpoints may work in a similar manner to drilling setpoints, except they operate to affect a planned trajectory. For example the planned path may remain valid unless gamma counts (or other geosteering indicator signal) exceed a user setpoint then planned inclination is reduced by an angular user setpoint until new planned trajectory is user setpoint-defined amount below previous planned trajectory.

A method of estimating toolface orientation between downhole updates during drilling in a subsurface formation includes encoding a drill string (such as with an encoder on a top drive) to provide angular orientation of the drill string at the surface of subsurface formation. The drill string in the formation is run in calibration to model drill string windup in the formation. During drilling operations, values of angular orientation of the drill string are read using the encoder. Toolface orientation may be estimated from the angular orientation of the drill string at the surface, with the drill string windup model accounting for windup between the toolface and the drill string at the surface. The toolface estimation based on surface measurement may fill the gaps between telemetric updates from measurement while drilling (MWD) tools on the bottom hole assembly (which are "snapshots" that may be more than 10 seconds apart).

In some embodiments, a string windup model is created based on a calibration test. In one embodiment, the drill string may be rotated in one direction until the BHA is rotating and a friction factor has stabilized, at which time the windup is measured. The drill string is then rotated in the opposite direction until the BHA is rotating and a friction factor has stabilized, at which time the windup is again measured. Based on the results of the calibration test, a live estimate of BHA toolface is used to fill in the gaps between downhole measurements readings.

As discussed previously, in some embodiments, a friction factor may be determined from test measurements. For example, a friction factor may be established from motor output and torque measured at the surface. A string windup may be determined analytically by calculating a torque for each element and cumulative torque below that element using the friction factor determined from test measurements. From the calculated torques, the twist turns for each element and total twist turns on surface may be determined.

In some embodiments, a surface rotary position is synchronized with downhole position to allow estimates of downhole toolface to be made based on windup variation caused by torque changes measured during drilling between toolface updates.

In certain embodiments, a system includes a graphical display of winding in a drill string. For example, a graphical display may show movement of wraps/rotation traveling up and down the string as torque turns change form either end of the drill string.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. In addition, it is to be understood that features described herein independently may, in certain embodiments, be combined.

The invention claimed is:

1. A method of steering a drill bit to form a hole having an inclination and an azimuth in a subsurface formation using a planned well path and at least first and second surveys, comprising:

a) determining a distance from design of a well, wherein the distance from design is the difference between the position of the bit at the second survey and the planned well path;

b) determining an angle offset from design of the well wherein angle offset from design is the difference between the inclination and azimuth of the hole and the inclination and azimuth of the planned well path, c) wherein at least one distance from design and at least one angle offset from design are determined in real time based, at least in part, on a position of the hole at the first survey, a position at a projected current location of the bit, and a projected position of the bit.

2. The method of claim 1, further comprising:

automatically determining one or more steering instructions based, at least in part, on the determined distance from design of the well and the determined angle offset from design of the well; and automatically steering the drill bit based, at least in part, on at least one of the steering instructions.

3. The method of claim 2, further comprising establishing a look-ahead distance wherein at least one of the one or more steering instructions is based, at least in part, on the established look-ahead distance.

4. The method of claim 3 wherein the look-ahead distance is specified by a user.

5. The method of claim 3 wherein automatically determining at least one steering instruction comprises determining an attitude of a plan at the established look-ahead distance.

6. The method of claim 2, further comprising specifying a convergence angle wherein the convergence angle varies depending on how far the location of the bit is from design wherein the larger the distance from the location of the bit to design, the larger the convergence angle.

7. The method of claim 6 wherein the convergence angle is determined automatically wherein the convergence angle is based on a sliding scale.

8. The method of claim 6 wherein at least one of the steering instructions is based on an angle determined for the plan at the look-ahead distance plus the specified convergence angle.

9. The method of claim 2, further comprising establishing at least one of a minimum slide distance and a maximum slide distance for a steering instruction.

10. The method of claim 2, further establishing at least one radial tuning parameter.

11. The method of claim 2, further establishing at least one rectangular tuning parameter.

12. The method of claim 1, further comprising:

receiving at least one input from a user; and automatically adjusting at least one steering instruction using the input from the user.

13. The method of claim 1, further comprising:

receiving at least one set point from a user; and automatically determining at least one steering instruction using the set point.

* * * * *